US006665412B1

(12) United States Patent
Mizoguchi

(10) Patent No.: US 6,665,412 B1
(45) Date of Patent: Dec. 16, 2003

(54) SPEAKER DEVICE

(75) Inventor: Akio Mizoguchi, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/341,454

(22) PCT Filed: Jan. 10, 1997

(86) PCT No.: PCT/JP97/00037

§ 371 (c)(1),
(2), (4) Date: Aug. 23, 1999

(87) PCT Pub. No.: WO98/31187

PCT Pub. Date: Jul. 16, 1998

(51) Int. Cl.[7] ..... H04R 1/02; H04R 9/06
(52) U.S. Cl. ..... 381/336; 381/345; 381/354
(58) Field of Search ..... 381/89, 92, 17, 381/97, 87, 345, 346, 347, 349, 353, 354, 350; 181/146, 151, 198

(56) References Cited

U.S. PATENT DOCUMENTS 5,301,237 A * 4/1994 Fosgate ..... 381/89

FOREIGN PATENT DOCUMENTS

| | | |
|---|---|---|
| JP | 54-153022 | 12/1979 |
| JP | 57-34717 | 7/1982 |
| JP | 58-10920 | 2/1983 |
| JP | 60-6154 | 2/1985 |
| JP | 62-316 | 1/1987 |
| JP | 62-3190 | 1/1987 |
| JP | 62-51896 | 3/1987 |
| JP | 63-26197 | 2/1988 |
| JP | 63-29356 | 8/1988 |
| JP | 4-88189 | 7/1992 |
| JP | 6-105391 | 4/1994 |

* cited by examiner

*Primary Examiner*—Minsun Oh Harvey
(74) *Attorney, Agent, or Firm*—Smith-Hill and Bedell

(57) ABSTRACT

The present invention relates to a speaker device or the like capable of stably providing desired directivity provided by a combination of omnidirectionality and bidirectionality down to ultra low frequencies. A speaker (22) is attached to one end face of a speaker box (21) and a sound wave radiation port (23) in a circular shape covered with acoustic resistance material (24) is installed at other end face thereof. The sound wave radiation port (23) is for radiating air vibration produced by a rear face of a speaker diaphragm to outside as sound wave and an axis penetrating the center extends in a direction of a principal axis (reference axis) of the speaker (22). A low pass filter is constituted by acoustic resistance and acoustic mass of the sound wave radiation port (23) and acoustic mass provided by air in the speaker box and a directivity is provided by utilizing group delay time in a pass band of sound wave radiated from the sound wave radiation port (23) via the low pass filter. The desired directivity can stably be provided down to ultra low frequencies by setting arbitrary group delay time regardless of dimensions or shape of the speaker box (21). By utilizing the directivity, a difference in sound pressure levels based on a difference in attenuation of sound in distances to two left and right channels is corrected and a listening range providing excellent stereophonic feeling can be enlarged.

14 Claims, 30 Drawing Sheets

30

SPEAKER DEVICE

TECHNICAL FIELD

The present invention relates to a speaker device capable of stably providing a desired directivity provided by a combination of omnidirectionality and bidirectionality, down to ultra low frequencies and capable of enlarging a listening range providing excellent stereophonic feeling by a comparatively small-sized system constitution and wherein excellence is capable of enlarging a listening range providing surround effect.

BACKGROUND OF THE INVENTION

Conventionally, there is known a speaker device of a closed type or an open back type. In this case, the directional characteristic at low frequencies constitutes omnidirectionality in a closed type speaker device and bidirectionality in an open-back type speaker device. Further, at middle and high frequencies where a speaker cannot be regarded as an ideal point sound source, radiated sound wave per se of the speaker is provided with directivity. That is, according to the conventional speaker device, as the directional characteristic at a low frequency region, only the omnidirectionality or the bidirectionality can be provided.

Further, FIG. 28 shows a state in which a conventional stereophonic speaker device is arranged in a test listening room 100. The speaker device is constituted by a left channel speaker device 1L having a sound signal reproducing speaker for reproducing a left channel sound signal and a right channel speaker device 1R having a sound signal reproducing speaker for reproducing a right channel sound signal.

According to such a speaker device, basically, at a listening position on a center line M of the speaker devices 1L and 1R, for example, at point a, correct sound image localization is provided between the speaker devices 1L and 1R by which inherent sound stage of a 2-channel stereophonic system is reproduced. However, at a listening position deviated from the center line M, for example, point b, there is constituted sound image localization deviated to a direction of the speaker device 1R owing to sound attenuation in distance of sound wave or the like and then inherent sound stage as the 2-channel stereophonic system is not reproduced.

That is, in FIG. 28, when sound signal reproducing speakers of the speaker devices 1L and 1R are driven by the same signal, sound image at a listening position on the center line M of the speaker devices 1L and 1R, for example, at point a, is localized in a center front direction as shown by an arrow mark. Accordingly, when ordinary stereophonic signals are reproduced, continuous sound stage is reproduced between the speaker devices 1L and 1R (illustrated by dot-dash-line La).

In this case, in respect of sound image localization of 2-channel stereophonic sound, in view of auditory sensation, the following property is known. When there is a difference in levels of sound pressures of sound waves from the speaker devices 1L and 1R, the sound image at a listening position on the center line M of the speaker devices 1L and 1R, for example, at point a, is moved in a direction of a speaker device having a higher sound pressure level. Further, when a delay time period of 1 through 30 ms is provided to either of signals for driving sound signal reproducing speakers of the speaker devices 1L and 1R, the sound image at a listening position on the center line M of the speaker devices 1L and 1R, for example, at point a, is moved in a direction of a speaker from which sound wave arrives earlier in time. This phenomenon is referred to as precedence effect, which is well known.

In view of such a property in auditory sensation, consider sound image localization at a listening position, for example, point b, deviated from the center line M of the speaker devices 1L and 1R. At point b, distances between a sound receiving point and the speaker devices 1L and 1R differ from each other and therefore, in the case where the directivities of the speaker devices 1L and 1R are omnidirectional, there causes a difference between arrival times of sound wave from the speaker devices 1L and 1R and there causes a difference in levels of sound pressures. That is, the arrival time is earlier in the case of sound wave from the speaker device 1R and the sound pressure level is higher in the case of sound wave from the speaker device 1R.

Accordingly, sound image at a listening position, for example, at point b, deviated from the center line M of the speaker devices 1L and 1R is localized to significantly deviate in a direction of the speaker device 1R as shown by an arrow mark in FIG. 28 owing to the above-described difference in sound pressure levels in addition to the precedence effect caused by time difference. Accordingly, sound stage in the case of reproducing ordinary stereophonic signals is deviated to a side of the speaker device 1R (illustrated by two-dot-dash-line Lb).

There has been proposed a method of utilizing the directivity of a conventional speaker with regard to a method of reproducing 2-channel stereophonic sound, which intends to improve the problem of deviation of the sound stage, mentioned above, that is, to enlarge the listening position providing excellent stereophonic feeling. In FIG. 29, sound signal reproducing speakers 2L and 2R of the speaker devices 1L and 1R are attached to closed type cabinets 3L and 3R such that respective principal axes (reference axes) are directed inwardly by about 45° in view from a central listening position, which is a method of utilizing directivities provided to speakers per se at middle and high frequencies based on the fact that diaphragms of the speakers 2L and 2R are provided with limited areas. Further, in FIG. 30, as sound signal reproducing speakers 4L and 4R of the speaker devices 1L and 1R in charge of middle and high frequencies, there are used bidirectional (directivity in 8-like shape) speakers and the speakers 4L and 4R are attached to baffle plates 6L and 6R in cabinets 5L and 5R front faces of which are opened such that respective principal axes thereof are directed inwardly by about 450° in view from a central listening position. Further, solid lines $a_L$ and $a_R$ respectively designate the directivities of the speakers 4L and 4R.

According to the examples shown by FIG. 29 and FIG. 30, by providing directivities to the sound waves radiated from the speaker devices 1L and 1R, the sound pressure level of sound wave from the speaker device 1R is reduced and the sound pressure level of left channel sound wave from the speaker device 1L is more or less increased at a listening position, for example, at point b, deviated from the center line M (refer to FIG. 28) so that the devices are operated to correct a difference between sound pressure levels based on a difference in sound attenuation in distances from the two left and right channels, whereby a listening position providing excellent stereophonic feeling is enlarged.

However, according to the example shown by FIG. 29, when the directivity is intended to provide from lower frequencies, the speakers 2L and 2R having larger apertures need to use and the system constitution becomes large-sized. Further, according to the example shown by FIG. 30, when the low frequency limit of the reproduction band is intended to widen, the baffle plates 6L and 6R attached to the speakers 4L and 4R need to enlarge. Similar to the example shown by FIG. 29, the system constitution becomes large-sized.

Further, FIG. 31 shows a state in which conventional front surround speaker devices are arranged in the test listening room 100. The speaker device is constituted by a left channel speaker device 11L and a right channel speaker device 11R. For example, the speaker device 11L is provided with a sound signal reproducing speaker for reproducing a left sound signal as well as a surround signal reproducing speaker for reproducing a surround signal, and the speaker device 11R is provided with a sound signal reproducing speaker for reproducing a right sound signal as well as a surround signal reproducing speaker for reproducing a surround signal.

In this case, the surround signal reproducing speakers are attached to speaker boxes such that principal axes thereof are directed in front directions of the speaker boxes or outwardly in respect of the front directions by predetermined angles. FIG. 31 shows an example in which principal axes of sound signal reproducing speakers 12L and 12R of the speaker devices 11L and 11R are directed in front directions $F_L$ and $F_R$ of speaker boxes 14L and 14R. Similarly, principal axes $SA_L$ and $SA_R$ of surround signal reproducing speakers 13L and 13R are directed in the front directions $F_L$ and $F_R$. Further, FIG. 32 shows an example in which the principal axes of the sound signal reproducing speakers 12L and 12R of the speaker devices 11L and 11R are respectively directed in the front directions $F_L$ and $F_R$ of the speaker boxes 14L and 14R. In contrast thereto, the principal axes $SA_L$ and $SA_R$ of the surround signal reproducing speakers 13L and 13R are directed outwardly in respect of the front directions $F_L$ and $F_R$ by predetermined angle $\delta$.

According to the front surround speaker device shown by FIG. 31, there is a drawback in which although inherent surround effect is achieved when listening is carried out at a listening position, for example, point e, on the center line M of the speaker devices 11L and 11R, the surround effect is significantly deteriorated when listening is carried out at a listening position, for example, at point f, deviated from the center line M. Hereinafter, a description will be given of significantly deteriorating the surround effect at a listening position deviated from the center line M in this way by explaining the principle of a 2-channel front surround stereophonic reproduction system.

The front surround stereophonic reproduction system is a system of achieving the surround effect by using two front speaker devices (speaker devices for left and right channels) and is a system in which sound image is produced not only in a front direction but also a transverse direction or a rear direction so that wide-angled sound stage is created in auditory sensation of a listener to provide the auditory sensation in listening to music in a wide theater to the listener. Accordingly, the front surround system is a pseudo-stereophonic sound reproduction system utilizing auditory sensation and is differentiated from an orthodox multiple-channel-stereophonic sound reproduction system, which intends to create a stereophonic actual sound field in an auditory space.

First, a 2-channel stereophonic signal is constituted by an M signal component of a monophonic signal and an S signal component providing a direction of sound image localization. That is, an L signal (left sound signal) of a left channel is a sum of two M and S components, that is, L=M+S and an R signal (right sound signal) of a right channel is a difference between the two M and S components, that is, R=M−S. Accordingly, the S signal component is nothing but a signal of a difference between the L signal and the R signal and is a signal the size and the polarity of which differ depending on a direction of sound image localization.

That is, at point e on the center line M of the speaker devices 11L and 11R of FIG. 31, when sound image is localized in a front central direction, the S signal component is null and only the M signal component is constituted. Further, when sound image is localized on the left side of the front central direction, the polarity of the S signal component becomes positive similar to that of the M signal component and when sound image is localized on the right side of the front central direction, the polarity of the S signal component becomes negative different from that of the M signal component. Accordingly, the S signal component can be expressed as $S=\pm S_0$, when sound image is localized on the left side of the front central direction, $L=M+(+S_0)=M+S_0$, $R=M-(+S_0)=M-S_0$, that is, L>R and when sound image is localized on the right side of the front central direction, $L=M+(-S_O)=M-S_0$, $R=M-(-S_0)=M+S_0$, that is, L<R.

Next, according to the front surround stereophonic reproduction system, there is adopted a method in which in addition to the L and R signals inherent to the 2-channel stereophonic system, a surround signal mainly composed of the S signal component is superposed on said L and R signals in conformity with the polarities of the S signal components of the L and R signals and the superposed signal is reproduced electrically or the surround signal is reproduced by using exclusive speakers thereto. Although the surround signal is basically and mainly composed of the S signal component, to achieve further real surround effect, the S signal component is subjected to a signal processing of time delay, addition of reverberation or emphasizing a specific frequency component or the like. That is, the front surround stereophonic reproduction system is basically nothing but a system in which the S signal component included in the inherent L and R signals is subjected to pertinent signal processing, is further emphasized and is reproduced. By adopting such a reproduction method, intended surround effect is achieved at a listening position, for example, at point e, on the center line M of the speaker devices 11L and 11R in FIG. 31.

In this case, a physical sound condition of the reproduced sound reproduced at a listening position, for example, at point e, on the center line M of the speaker devices 11L and 11R constitutes a condition in which respective signal sound components of M, S and surround radiated from the speaker devices 11L and 11R are provided with equal magnitudes and arrive at the same time. This condition is a condition for reproducing continuous sound stage in auditory sensation between the speaker devices 11L and 11R by the two signal sound components M and S and achieving intended surround effect by the surround signal sound components, and is extremely important. However, at a listening position, for example, at point f, deviated from the center line M of the speaker devices 11L and 11R in FIG. 31, the level difference and the time difference are caused in reproduced sounds of the speaker devices 11L and 11R and then it does not satisfy the above-described condition.

Further, when the surround signals are reproduced by the exclusive speakers 13L and 13R (refer to FIG. 32 and FIG. 33), the principal axes $SA_L$ and $SA_R$ of the speakers 13L and 13R are directed in the front direction or the outward directions in view from a listening position, for example, at point e, on the center line M of the speaker devices 11L and 11R. As such surround signal reproducing speakers 13L and 13R, there are generally used small-sized speakers having an aperture of about 8 cm. In the case of a small-sized speaker having an aperture of about 8 cm, as shown by FIG. 34, a directivity which is dependent on the aperture begins to provide from a frequency of about 1 KHz and the higher the frequency, the sharper the directivity is provided.

Accordingly, in respect of the surround signal sound at a listening position, for example, at point f, deviated from the center line M of the speaker devices 11L and 11R in FIG. 31, the surround signal sound becomes larger on the right channel side and smaller on the left channel side owing to a difference in the directivities and attenuation of sound waves in distances caused by differences in directions and distances of the speaker devices 11L and 11R. Particularly, in the case in which the principal axes of the surround signal reproducing speakers 13L and 13R are directed outwardly (refer to FIG. 33), the difference in levels caused by the directivities of the surround signal sounds from the left and right channels becomes further significant. Therefore, the surround effect at a listening position, for example, at point f, deviated from the center line M of the speaker devices 11L and 11R in FIG. 31 is significantly deteriorated as mentioned above.

In view of the above-described points, it is an object of the present invention to provide a speaker device capable of stably providing desired directivity provided by a combination of omnidirectionality and bidirectionality, down to ultra low frequencies. Further, it is another object of the present invention to provide a stereophonic speaker device capable of enlarging a listening range providing excellent stereophonic feeling by a comparatively small-sized system constitution. Further, it is still another object of the present invention to provide a front surround speaker device capable of enlarging a listening range providing excellent surround effect.

DISCLOSURE OF THE INVENTION

According to an aspect of the present invention, there is provided a stereophonic speaker device comprising a left channel speaker device having a first speaker for reproducing a left channel sound signal and a right speaker device having a second speaker for reproducing a right channel sound signal, characterized in that a first speaker portion constituted by the first speaker of the left channel speaker device and a second speaker portion constituted by the second speaker of the right channel speaker device are provided with directivities each provided by a combination of a bidirectionality and an omnidirectionality having a maximum sensitivity on a front principal axis of the speaker and that the first speaker of the left channel speaker device and the second speaker of the right channel speaker device are attached to the speaker boxes such that principal axes thereof are inclined by a first angle respectively in a counterclockwise direction and a clockwise direction relative to front directions of the speaker boxes.

Further, according to still another aspect of the present invention, there is provided a stereophonic speaker device comprising a left channel speaker device having a first and a second speakers for reproducing a left channel sound signal and a right channel speaker device having a third and a fourth speakers for reproducing a right channel sound signal, characterized in that a first speaker portion constituted by the second speaker of the left channel speaker device and a second speaker portion constituted by the fourth speaker of the right channel speaker device are provided with directivities each provided by a combination of a bidirectionality and an omnidirectionality having a maximum sensitivity on a front main axis of each of the speakers, that the first speaker of the left channel speaker device and the third speaker of the right channel speaker device are attached to speaker boxes such that respective axes thereof coincide with front directions of the speaker boxes, and that the second speaker of the left channel speaker device and the fourth speaker of the right channel speaker device are attached to the speaker boxes such that principal axes thereof are inclined by a first angle respectively in a counterclockwise direction and a clockwise direction relative to the front directions of the speaker boxes.

The principal axes of the speakers constituting the first and the second speaker portions for reproducing sound signals of the left channel speaker device and the right channel speaker device, are directed inwardly in view from a listening position on the center line of the two speaker devices. Accordingly, by the directivities of the first and the second portions each provided by the combination of the bidirectionality and the omnidirectionality, a difference in sound pressure levels based on a difference in attenuation of sound in distances to the two left and right channels is corrected at a listening position deviated from the center line of the two speaker devices, thereby a listening range providing excellent stereophonic feeling is expanded.

According to further aspect of the present invention, there is provided a stereophonic speaker device comprising a left channel speaker device having a first speaker for reproducing a left channel sound signal and a second speaker for reproducing a surround signal and a right channel speaker device having a third speaker for reproducing a right channel sound signal and a fourth speaker for reproducing the surround signal, characterized in that the first speaker of the left channel speaker device and the third speaker of the right channel speaker device are attached to speaker boxes such that principal axes thereof are inclined by a first angle respectively in a counterclockwise direction and a clockwise direction relative to front directions of the speaker boxes, that the second speaker of the left channel speaker device and the fourth speaker of the right channel speaker device are attached to the speaker boxes such that principal axes thereof are inclined by the first angle or by a second angle different from the first angle respectively in the counterclockwise direction and the clockwise direction relative to the front directions of the speaker boxes and that a first speaker portion constituted by the first speaker of the left channel speaker device and a second speaker portion constituted by the third speaker of the right channel speaker device are provided with directivities each provided by a combination of a bidirectionality and an omnidirectionality having a maximum sensitivity on the front principal axis of each of the speakers.

Further, according to still further aspect of the present invention, there is provided a stereophonic speaker device comprising a left channel speaker device having a first and a second speakers for reproducing a left channel sound signal and a third speaker for reproducing a surround signal and a right speaker device having a fourth and a fifth speakers for reproducing a right channel sound signal and a sixth speaker for reproducing the surround signal, characterized in that the first speaker of the left channel speaker device and the fourth speaker of the right channel speaker device are attached to speaker boxes such that principal axes thereof coincide with respective front directions of the speaker boxes, that the second speaker of the left channel speaker device and the fifth speaker of the right channel speaker device are attached to the speaker boxes such that principal axes thereof are inclined by a first angle respectively in a counterclockwise direction and a clockwise direction relative to the front directions of the speaker boxes, that the third speaker of the left channel speaker device and the sixth speaker of the right channel speaker device are attached to the speaker boxes such that principal axes thereof are inclined by the first angle or a second angle different from the first angle respectively in the counterclockwise direction and the clockwise direction relative to the front directions of the speaker boxes and that a first speaker portion constituted by the second speaker of the right channel speaker device and a second speaker portion constituted by the fifth speaker of the right channel speaker device are provided with directivities each provided by a combination of a bidirectionality and an omnidirectionality having a maximum sensitivity on a front principal axis of each of the speakers.

The principal axes of the speakers constituting the first and the second speaker portions for reproducing sound signals of the left channel speaker device and the right channel speaker devices are directed inwardly in view from a listening position on the center line of the two speaker devices. Accordingly, by the directivities of the first and the second speaker portions each provided by the combination of the bidirectionality and the omnidirectionality, a difference in sound pressure levels based on a difference in attenuation of sound in distances to the two left and right channels is corrected at a listening position deviated from the center line of the two speaker devices, thereby the listening range providing excellent stereophonic feeling is expanded. Further, the principal axes of the third and the sixth speakers for reproducing the surround signal of the left channel and the right channel speaker devices are directed inwardly in view from a listening position on the center line of the two speaker devices. Therefore, at a listening position deviated from the center line of the two speaker devices, by the directivities of the speaker for reproducing the surround signal at middle and high frequencies, a difference in levels based on a difference in attenuation of sound in distances of the surround signal sound of the two left and right channels is corrected. Thus, an effect of enlarging a listening range in respect of the above-described reproduced sound for sound signal (LR signal) is added and the listening range providing excellent surround effect is further enlarged.

BEST MODE FOR CARRYING OUT THE INVENTION

Figure 1:
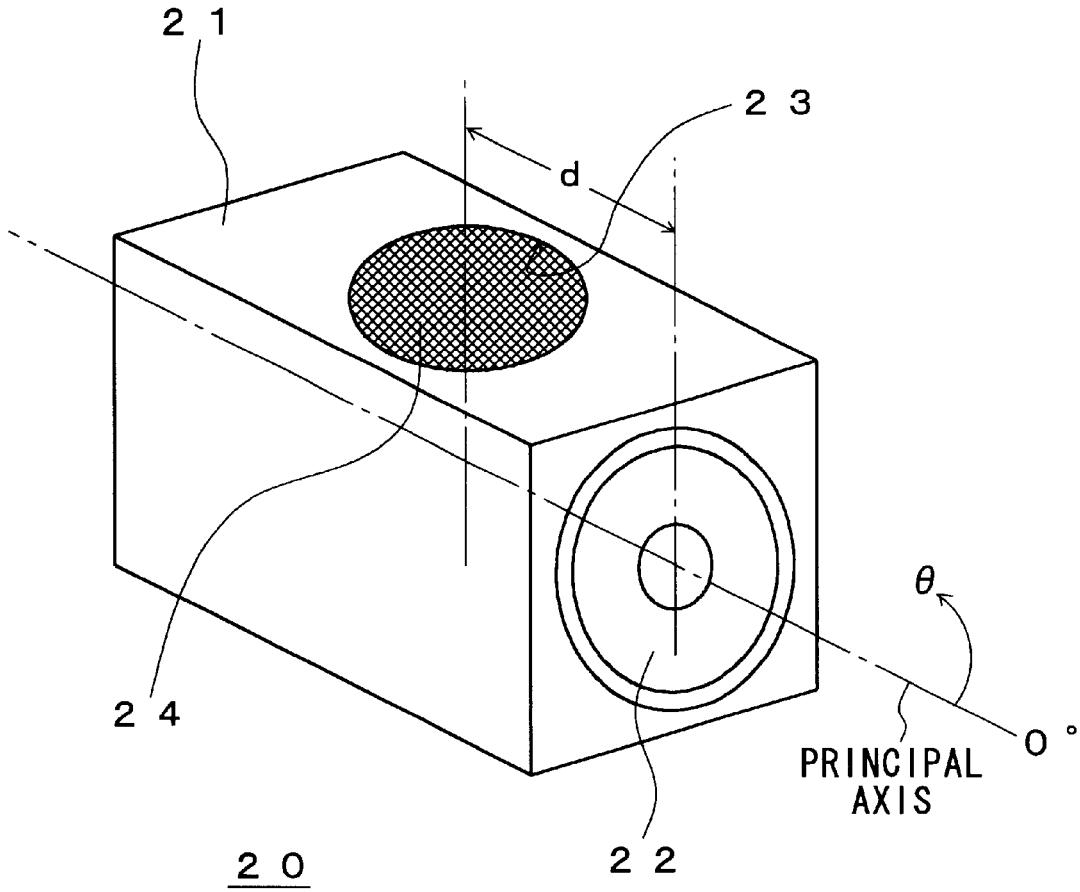
FIG. 1 is a perspective view showing a speaker device according to the present invention.

FIG. 1 shows a speaker device 20 as a best mode. A speaker 22 is attached to one end face of a speaker box 21 in a shape of a rectangular parallelepiped and a sound wave radiation port (opening portion) 23 in a circular shape covered with an acoustic resistance material 24 is installed at an end face thereof (upper face in the drawing) different from the one end face. The sound wave radiation port 23 intends to radiate air vibration produced at a rear face of a speaker diaphragm to the outside as sound wave and is formed so that an axis penetrating the center thereof extends in a direction of a principal axis (reference axis) of the speaker 22.

Figure 2:
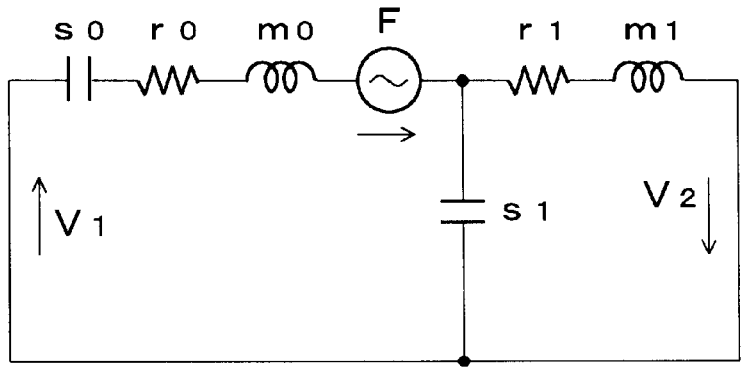
FIG. 2 is a circuit connection diagram showing an equivalent circuit of a mechanical system of the speaker device.

An equivalent circuit of a mechanical system of the speaker device 20 in which an electric system and an acoustic system thereof are equivalently converted into said mechanical system, is represented as shown by FIG. 2 regarding middle and low frequencies. In the drawing, notation F designates vibratory force for moving the diaphragm and is expressed as shown by Equation (1) under constant voltage drive.

$$F = \frac{BlE}{Rv} \tag{1}$$

E: Drive voltage of voice coil

Rv: Electric resistance of voice coil

Bl: Force factor (B: Magnetic flux density of magnetic flux gap, l: Effective length of voice coil)

Notation $s_0$ designates equivalent stiffness of an elastic support member of the diaphragm, notation $r_0$ designates equivalent mechanical resistance including electromagnetic brake resistance and notation $m_0$ designates effective mass of the diaphragm. Notation $s_1$ designates equivalent stiffness that elasticity of air in a speaker box is converted into an area of the diaphragm, and the s1 is represented by Equation (2) in which notation V designates volume of air in the speaker box and notation A designates an effective area of the diaphragm.

$$s_1 = \frac{\rho c^2 A^2}{V} \tag{2}$$

(ρ: Density of air, c: Sound speed)

Notation $r_1$ designates equivalent mechanical resistance that acoustic resistance of the acoustic resistance material 24 of the sound wave radiation port 23 is converted into an area of the diaphragm, and notation ml designates equivalent mass that acoustic mass dependent on the structure of the sound wave radiation port 23 and sound wave radiation is converted into an area of the diaphragm. Notation $V_1$ designates vibration speed of the diaphragm and notation $V_2$ designates equivalent vibration speed that vibration speed of air at the sound wave radiation port 23 is converted into an area of the diaphragm.

Further, in the above-described speaker device 20, radiation resistances are respectively present on the side of the diaphragm of the speaker 22 and on the side of the sound wave radiation port 23 and power supplied to the radiation resistances is radiated in the air as acoustic power. However, the radiation resistances are very small values compared with the $r_0$ and the $r_1$ and do not influence on the $V_1$ and the $V_2$ Accordingly, they are omitted in the equivalent circuit of FIG. 2.

Figure 3:
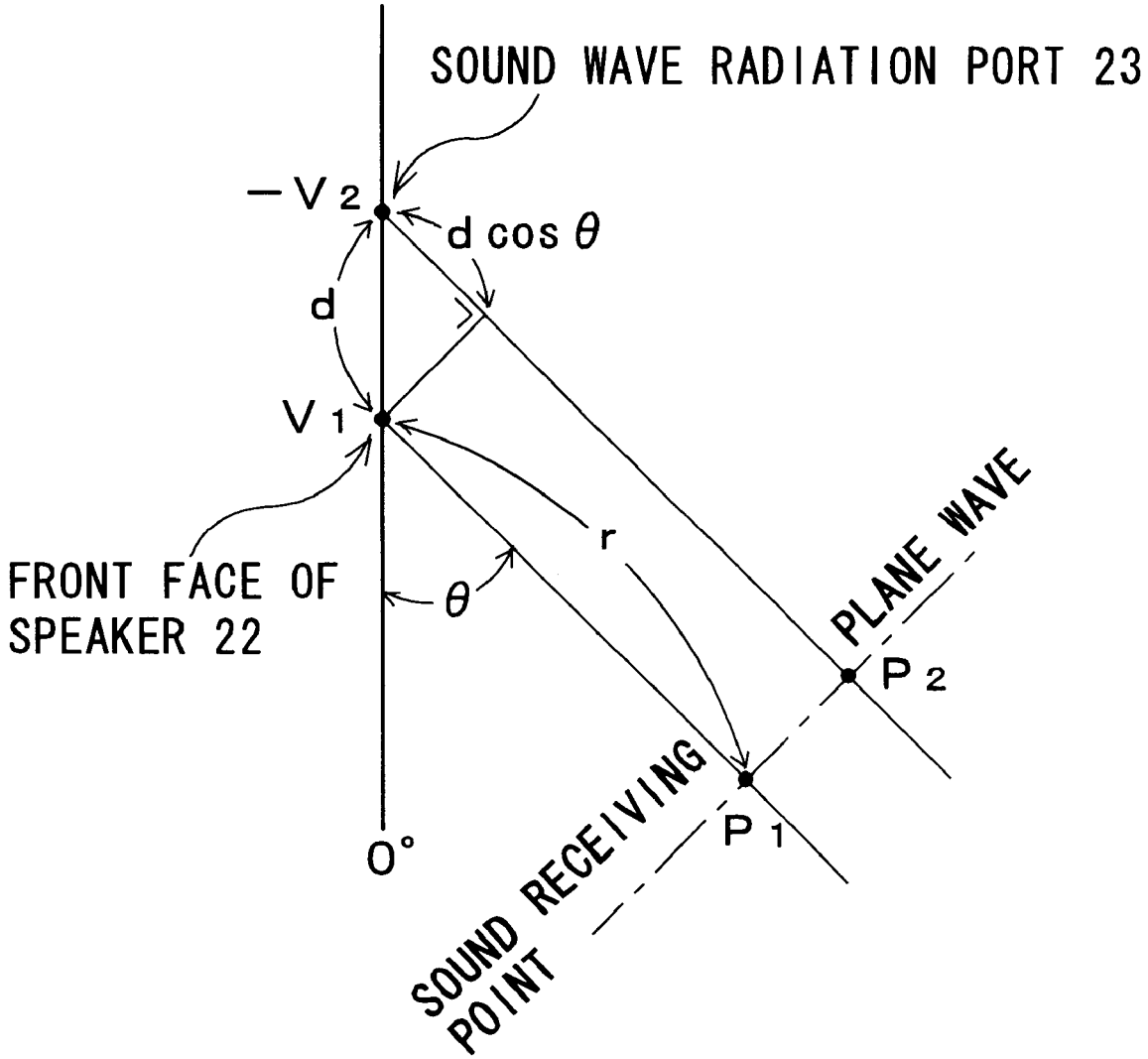
FIG. 3 is a diagram for theoretical analysis of synthesized sound pressure.

Next, in reference to FIG. 3, a theoretical analysis will be given of synthesized sound pressure of sound waves radiated from two sound sources of a front face of the speaker 22 (front face of speaker diaphragm) and the sound wave radiation port 23. In this case, notation d designates a spatial distance in the principal axis direction of the speaker 22 between the two sound sources of the front face of the speaker 22 and the sound wave radiation port 23. Further, attention is paid to one-directional components on a horizontal plane of the sound waves radiated from the two sound sources of the front face of the speaker 22 and the sound wave radiation port 23, and then direction of the principal axis in the direction of the front face of the speaker is set to 0° and an angle made by the principal axis and the direction on which the attention is paid (direction of sound receiving position) is set to θ in the counterclockwise direction.

In the drawings, when d is 8 through 10 cm and a distance r between the sound receiving position and the speaker 22 is equal to or more than 1 m, the two sound sources of the front face of the speaker 22 and the sound wave radiation port 23 can be regarded as point sound sources at middle and low frequencies. Further, the sound wave at the sound receiving position may be regarded as substantially a plane wave.

When handled in this way, sound pressure $P_1$ at the sound receiving position of the sound wave radiated from the front face of the speaker 22 is represented by Equation (3) since the vibration speed of the diaphragm is designated by notation $V_1$.

$$P_1 = \frac{j\omega\rho A V_1}{4\pi r} e^{-j\frac{\omega r}{c}} \tag{3}$$

Next, sound pressure $P_2$ at the sound receiving position of the sound wave radiated from the sound wave radiation port 23 is delayed relative to the $P_1$ over time in correspondence with a distance of dcos θ and is provided with negative polarity since the sound wave is based on air vibration at the rear face of the diaphragm and accordingly, the sound pressure $P_2$ is represented by Equation (4). Incidentally, d<<r.

$$P_2 = \frac{j\omega\rho A V_2}{4\pi r} e^{-j\frac{\omega r}{c}} \cdot e^{-j\frac{\omega d}{c}\cos\theta} \tag{4}$$

Therefore, the synthetic round pressure P(θ) is $P_1+P_2$ and accordingly, it is represented by Equation (5).

$$P(\theta) = \frac{j\omega\rho A}{4\pi r} e^{-j\frac{\omega r}{c}} \left(V_1 - V_2 e^{-j\frac{\omega d}{c}\cos\theta}\right) \tag{5}$$

Here, it is apparent from the equivalent circuit of FIG. 2, the vibration speed $V_2$ is represented by Equation (6)

$$V_2 = \frac{V_1}{1 + j\omega\frac{r_1}{s_1} + (j\omega)^2\frac{m_1}{s_1}} \tag{6}$$

Equation (6) shows a characteristic of a secondary low pass filter and generates group delay time having a constant value determined by $s_1$, $r_1$ and $m_1$ in pass band. This time delay and the time delay changed by θ of dcos θ/c provided in space, result in the directivity having a combination of bidirectionality and omnidirectionality. Hence, Equation (7) is established by substituting Equation (6) for Equation (5) to rearrange Equation (5) with setting ω/c=k.

$$P(\theta) = \frac{j\omega\rho A V_1 e^{-jkr}\cdot jkd}{4\pi r\left(1 + j\omega\frac{r_1}{s_1} + (j\omega)^2\frac{m_1}{s_1}\right)} \times \left\{\frac{1 - e^{-jkd\cos\theta}}{jkd} + \frac{r_1 c}{s_1 d} + jkd\cdot\frac{m_1}{s_1}\left(\frac{c}{d}\right)^2\right\} \tag{7}$$

In Equation (7), when the first term in {} is expanded in series, Equation (8) is resulted.

$$\frac{1 - e^{-jkd\cos\theta}}{jkd} = \cos\theta - \frac{jkd\cos^2\theta}{2!} + \frac{(jkd)^2\cos^3\theta}{3!} - \frac{(jkd)^3\cos^4\theta}{4!} + \ldots \tag{8}$$

As is apparent from Equation (8), at frequencies of kd<<1, when higher order terms of the primary order and higher of jkd are omitted, Equation (8) becomes cos θ. Therefore, the first term in {} of Equation (7) represents a bidirectional component. In contrast thereto, the second term and the third term in {} of Equation (7) do not depend on θ and accordingly, they represents an omnidirectional component.

When Equation (9) is put and P(θ ) is shown by normalizing with the sound pressure P(0° ) in the front direction (θ=0°), Equation (8) is represented by Equation (10) at frequency of kd<<1.

$$\frac{r_1 c}{s_1 d} = \alpha \tag{9}$$

$$\frac{P(\theta)}{P(0°)} = \frac{\cos\theta + \alpha}{1 + \alpha} = \frac{\cos\theta}{1 + \alpha} + \frac{\alpha}{1 + \alpha} \tag{10}$$

As is apparent from Equation (10), the synthesized sound pressure P(θ) is provided with a directivity having a combination of a bidirectional component and an omnidirectional component. Distribution of the two components can be changed by a value of α representing the omnidirectional component. The value a represents a ratio of $r_1/s_1$ to d/c as apparent from Equation (9). In FIG. 2, $r_1/s_1$ represents the group delay time period in the pass band of the low pass filter constituted by $r_1$, $s_1$, and $m_1$. Notation d/c designates a time period required for sound wave to propagate by the space distance d relating to the principal axis direction of the two sound sources of the front face of the speaker 22 and the sound wave radiation port 23.

Figure 4:
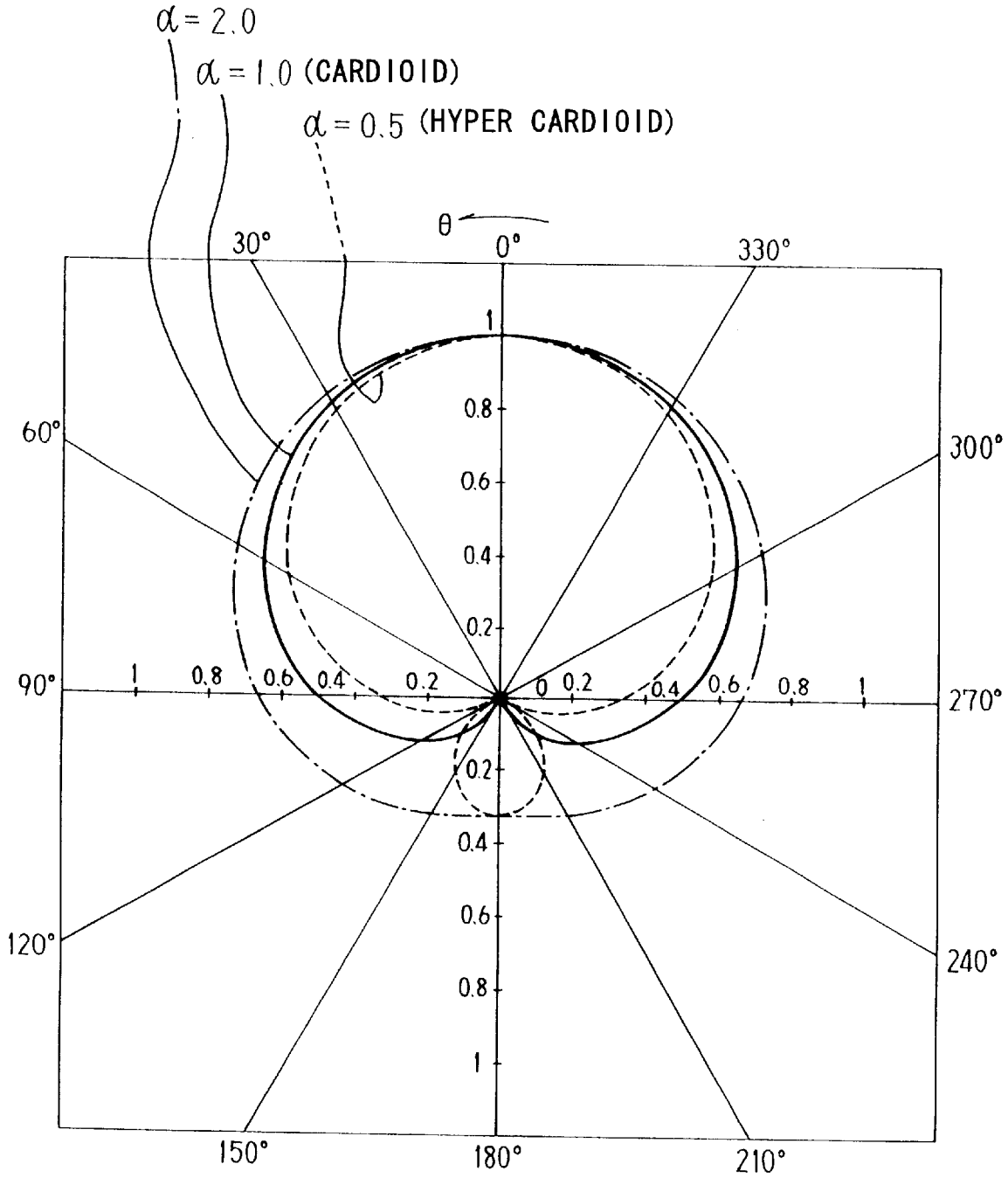
FIG. 4 is a diagram showing directivity patterns when $\alpha$ is changed.

FIG. 4 shows a result of calculating directivity patterns from Equation (10) in the cases of the values of α of 0.5, 1.0 and 2.0.

In Equation (10), when α≦1, P(θ) becomes null at a certain angle. However, when α>1, P(θ) does not become null at any angle. In the case of α≦1, if an angle θ for nullifying P(θ) is designated by notation $\theta_1$, as shown by FIG. 4, when α=1, $\theta_1$ is equal to 180° and when α=0.5, $\theta_1$ becomes two directions of 120° and 240°. In this way, P(θ) becomes null at $\theta=\theta_1$ since the higher order terms of the primary order term and higher of jkd present in the bidirectional component represented by Equation (8) are omitted. However, actually, there are present the higher order terms and accordingly, the higher the frequency, the more the directivity pattern of the bidirectional component is deviated from 8-like shape of an intrinsic circle. As a result, the synthesized directivity pattern becomes different from the basic directivity pattern shown by Equation (10). That is, the directivity is deteriorated.

In order to reduce the degree of deterioration of directivity up to higher frequencies, higher order terms of the primary order term or higher of jkd present in the bidirectional component represented by Equation (8) maybe canceled up to higher orders by using the omnidirectional component at a certain angle. When taking a look at Equation (7) and Equation (8), by the third term in {} of Equation (7), the primary term of jkd in Equation (8) can be canceled at a certain angle.

Hence, when in respect of the third term in {} of Equation (7) , Equation (11) is put and the canceling angle θ is designated by notation $\theta_2$, the condition of canceling is represented by Equation (12). In Equation (12), in respect of $\cos^2\theta_2$, $\cos^2\theta_2 \leqq 1$ in a range of $\theta_2=0°$ through 360°. Therefore, the value of β satisfying Equation (12) is β≦0.5.

$$\frac{m_1}{s_1}\left(\frac{c}{d}\right)^2 = \beta \tag{11}$$

$$\frac{\cos^2\theta_2}{2} = \beta \tag{12}$$

Figure 5:
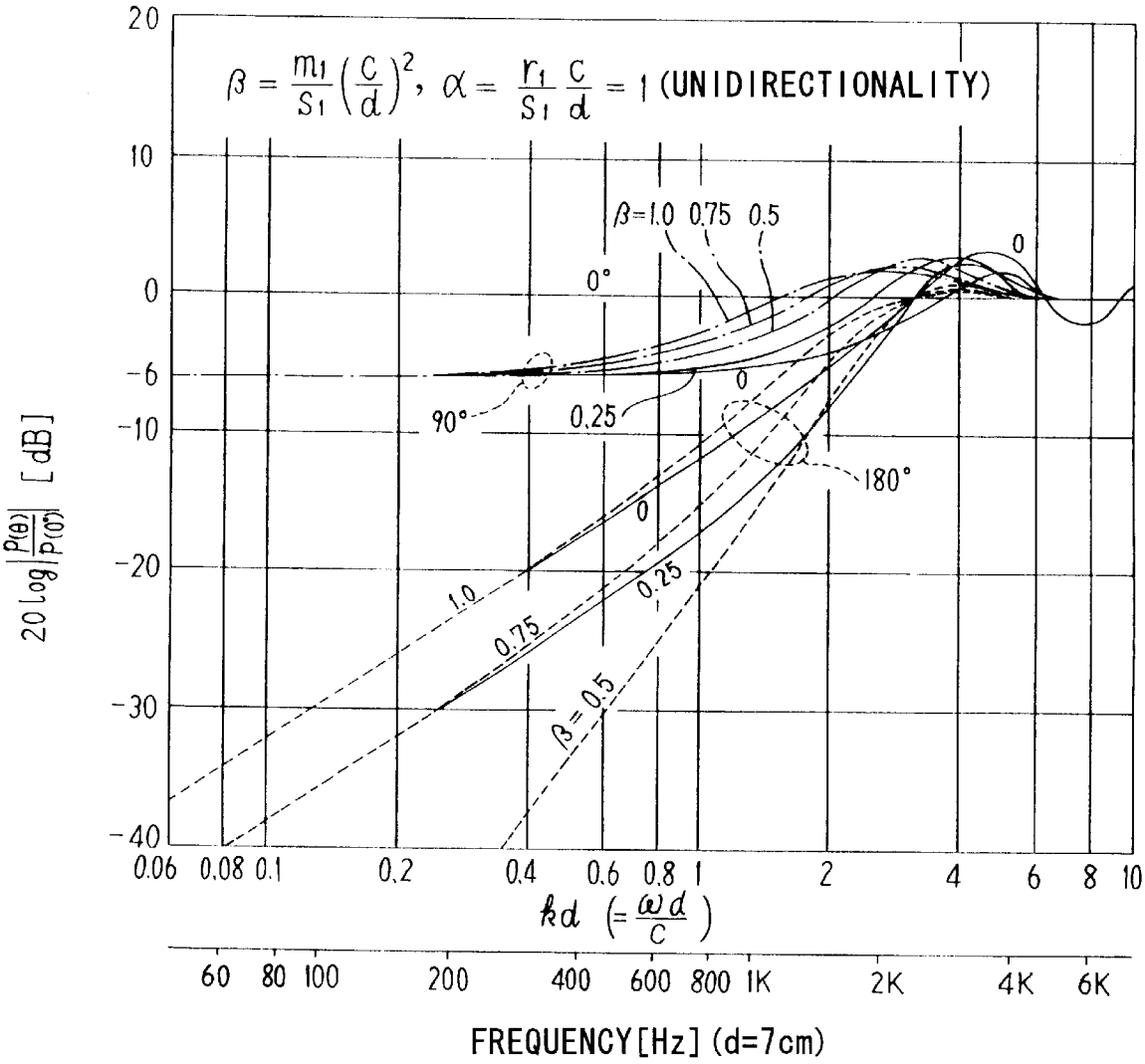
FIG. 5 is a diagram showing a directivity frequency characteristic by a value of $\beta$.

FIG. 5 shows a result in which the value of β is changed in 5 stages of 0 through 1 in the case of α=1 (unidirectionality) and a change of P(θ)/P(0°) in frequencies at angles of θ of 90° and 180° is calculated based on Equation (7). In this case, the condition of β=0 signifies $m_1=0$. However, actually, $m_1$ cannot be nullified and accordingly, the condition of β=0 cannot be realized.

As apparent from FIG. 5, at low frequencies of kd≦0.4, there is constituted a unidirectional pattern in which the synthesized sound pressure level in the rear face direction (θ=180°) of the speaker 22 becomes lower than that in the front direction (θ=0°) by 20 dB or more and the synthesized sound pressure level in the transverse direction (θ=90°) becomes lower than that in the front direction by 6 dB. However, the directivity is deteriorated by an increase in the frequencies and almost no directivity is provided at a frequency of kd≈π. The degree of deteriorating the directivity differs depending on the value of β.

Figure 6:
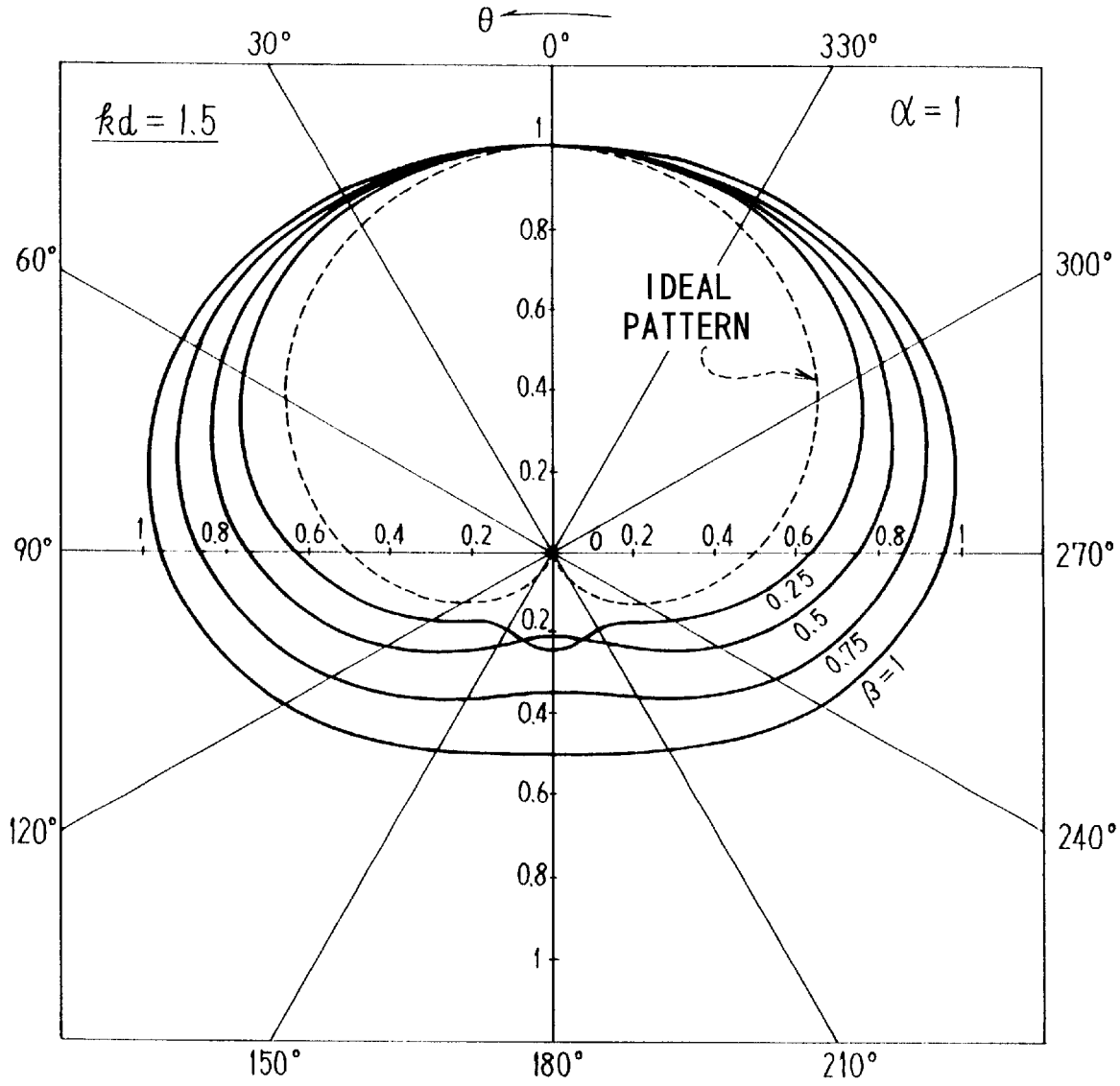
FIG. 6 is a diagram showing directivity patterns when $\beta$ is changed.

FIG. 6 shows a behavior of changing the directivity pattern at a frequency of kd=1.5 (f=1.2 KHz when d=7 cm) according to the values of β. As is apparent from the diagram, although the value of β cannot be nullified, it is necessary to set the value of β to a value as small as possible in order to provide excellent directivity up to higher frequencies. When the value of β is set to be equal to or smaller than 0.5, the frequency of kd=1.5 is regarded as a substantial high frequency limit of the directivity.

The above-described theoretical investigation has been carried out in respect of middle and low frequencies where the front face of the speaker 22 and the sound wave radiation port 23 can be regarded as ideal point sound sources. However, actually, the diaphragm of the speaker 22 and the sound wave radiation port 23 are provided with limited areas and accordingly, the respective radiating sound waves per se are provided with directivities at middle and high frequencies. Accordingly, it is proper to apply provision of directivity utilizing group delay time as mentioned above to middle and low frequencies where radiating sound waves of the speakers per se are not provided with directivities.

The directivity of the speaker per se differs depending on dimensions and shape of a speaker box to which the speaker is attached and an aperture of the speaker and so on. However, a frequency at a limit where the speaker starts providing directivity has a relationship of inverse proportion to the aperture of the speaker. The following is established when investigating theoretical analysis, actual measurement result and so on, which have already been known. That is, when notation D designates an effective diameter of a speaker diaphragm, the limit frequency where the speaker starts providing directivity can be regarded as a frequency satisfying Equation (13).

$$\frac{\omega}{c}D = \frac{\pi}{2} \tag{13}$$

When Equation (13) is represented by wavelength λ of radiating sound wave, from a relationship of $\omega/c=2\pi/\lambda$, $4D=\lambda$ and accordingly, the wavelength λ of the radiating sound wave may be regarded as a frequency 4 times as much as the effective diameter D of the diaphragm. Hence, it is proper to establish a setting condition shown below in order to apply provision of directivity utilizing group delay time as mentioned above to a frequency range of a frequency at a limit where the speaker starts providing directivity or below.

According to the speaker device 20 shown by FIG. 1, as previously described, the substantial high frequency limit of the directivity may be regarded as a frequency satisfying Equation (14).

$$\frac{\omega}{c}d = \frac{\pi}{2} \tag{14}$$

Hence, it seems to be proper that the frequency is set to a frequency where the speaker 22 per se starts providing directivity in the radiating sound wave thereof, that is, the frequency satisfying Equation (13). Therefore, the setting condition becomes as shown by Equation (15) from Equations (13) and (14).

$$d=D \tag{15}$$

That is, it is proper to set the spatial distance d in the principal axis direction of the two sound sources of the front face of the speaker 22 and the sound wave radiation port 23 equal to the effective diameter D of the speaker diaphragm. Further, this setting condition is established also in respect of the directivity in a range of $\alpha=0.5$ through 2.0 centering on the unidirectionality of $\alpha=1$.

Next, a description will be given of an embodiment when the directivity is set to be unidirectional.

A dynamic speaker is used as the speaker 22, which has the aperture of 8 cm, the effective diameter of the diaphragm of 7 cm and the effective area of 38.5 $cm^2$. The speaker box 21 is in a shape of a rectangular parallelepiped, dimensions of the speaker attaching face is 8.6 cm in height and breadth and 14 cm in depth and volume of air in the speaker box is 600 $cm^3$. The sound wave radiation port 23 is circular and is installed at the upper face of the speaker box 21 and the effective area of the sound wave radiation port 23 is 26 $cm^2$. Further, the spatial distance d in the principal axis direction of the two sound sources of the front face of the speaker 22 and the sound wave radiation port 23 is set to 7 cm from the condition of Equation (15).

The acoustic resistance of the acoustic resistance material 24 of the sound wave radiation port 23 is $r_1$=0.745 (kg/sec) in MKS unit when represented by the equivalent mechanical resistance converted into an area of the speaker diaphragm from Equations (2) and (9). Accordingly, the equivalent mechanical resistance $r_1'$ represented by the effective area of the sound wave radiation port 23 is calculated by Equation (16) when the effective area of the sound wave radiation port 23 is designated by notation $A_1$. Therefore, an acoustic resistance density (equivalent mechanical resistance per unit area) of the acoustic resistance material 24 of the sound wave radiation port 23 becomes 130.8 (kg/sec·$m^2$) by dividing Equation (16) by $A_1$.

$$r_1' = r_1\left(\frac{A_1}{A}\right)^2 = 0.3 \text{ [kg/sec]} \tag{16}$$

Figure 7:
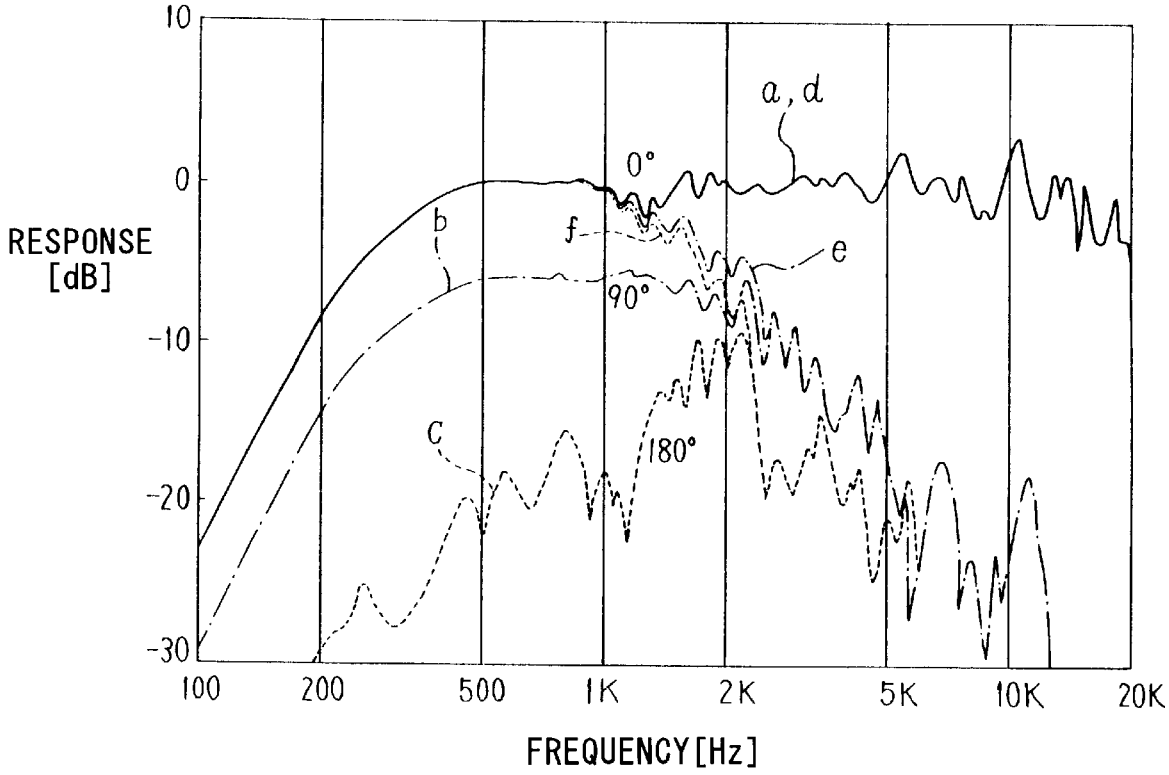
FIG. 7 is a diagram showing a frequency characteristic of output sound pressure of the speaker device.

A bold line a, a dot-dash line b and a broken line c of FIG. 7 show frequency characteristics of the directivity of the output sound pressure of the speaker device 20 according to the embodiment and it is found that the speaker device 20 is provided with unidirectionality at middle and low frequencies. The frequency of the limit where the speaker per se starts providing directivity becomes about 1.2 KHz from Equation (13) when the effective diameter of the diaphragm is 7 cm. Therefore, by setting d=D=7 cm, at frequencies of about 1.5 KHz or lower, there is provided the unidirectionality which is regarded as practically sufficient. A bold line d, a dot-dash line e and a broken line f of FIG. 7 show frequency characteristics of the directivity of the output sound pressure when the sound wave radiation port 23 is not installed and it is provided with no directivity at middle and low frequencies.

Further, although not mentioned above, in the speaker device 20 of FIG. 1, there may be installed opening area variable means for making the area of the sound wave radiation port 23 variable. As the opening area variable means, there can be conceived one like, for example, an iris mechanism of a camera. When the area of the sound wave radiation port 23 is changed, the acoustic resistance and the acoustic mass of the sound wave radiation port 23 are changed and then the group delay time in the pass band of the sound wave radiated from the sound wave radiation port 23 via a low pass filter constituted by the acoustic resistance, the acoustic mass and an acoustic capacitance provided by air in the speaker box, is changed. Therefore, by providing the opening area variable means, the group delay time can arbitrarily be adjusted and the user can simply carry out adjustment of the directivity characteristic.

Further, the aperture of the sound wave radiation port 23 and the acoustic resistance density of the acoustic resistance material 24 can pertinently be selected without being restricted to numerical values in the above-described explanation.

In this way, according to the speaker device 20 shown by FIG. 1, the low pass filter is constituted by the acoustic resistance and the acoustic mass of the sound wave radiation port 23 and the acoustic capacitance provided by air in the speaker box 21, and accordingly, the directivity is provided by utilizing the group delay time in the pass band of the sound wave radiated from the sound wave radiation port 23 via the low pass filter. Therefore, the desired directivity can stably be provided down to ultra low frequencies by setting the arbitrary group delay time regardless of dimensions or shape of the speaker box 21.

For example, by setting the group delay time to ½ through 2 times as much as the time period required for the sound wave to propagate by the spatial distance in the principal axis direction of the two sound sources of the front face of the speaker 22 and the sound wave radiation port 23, there can be provided the directivity having a combination of omnidirectionality and bidirectionality such as in a shape of hyper cardioid, cardioid (unidirectionality) or the like.

Further, by setting the spatial distance d in the principal axis direction of the two sound sources of the front face of the speaker 22 and the sound wave radiation port 23 to a value of 0.7 through 1.5 times as much as the effective diameter D of the speaker diaphragm, the desired directivity can effectively be provided by being limited to the frequency range of the frequency where the speaker per se starts providing directivity or lower.

Figure 8:
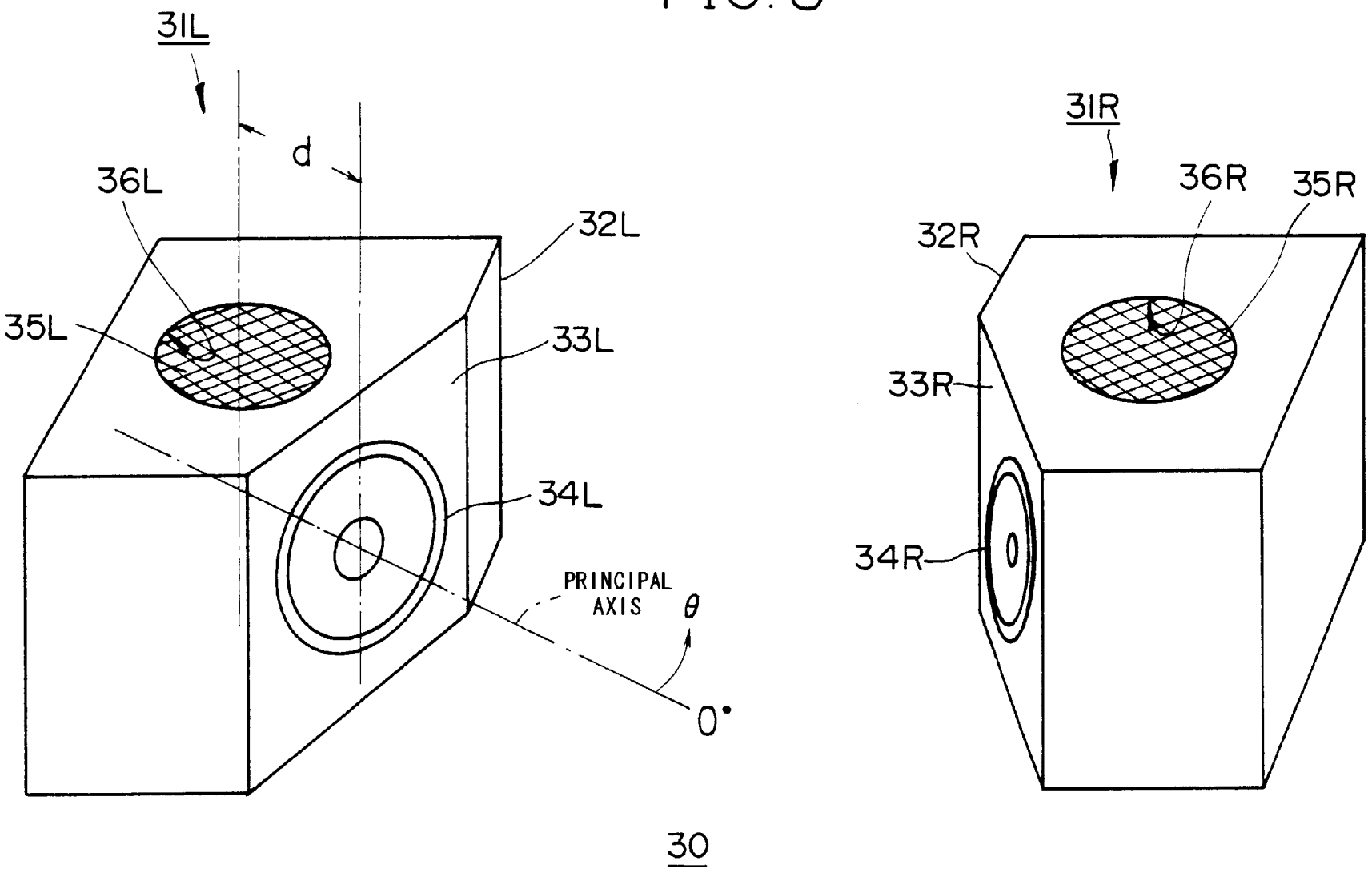
FIG. 8 is a perspective view showing a stereophonic speaker device according to the present invention.

Next, FIG. 8 shows a stereophonic speaker device 30 as another best mode. The speaker device 30 is constituted by a left channel speaker device 31L and a right channel speaker device 31R.

Figure 9:
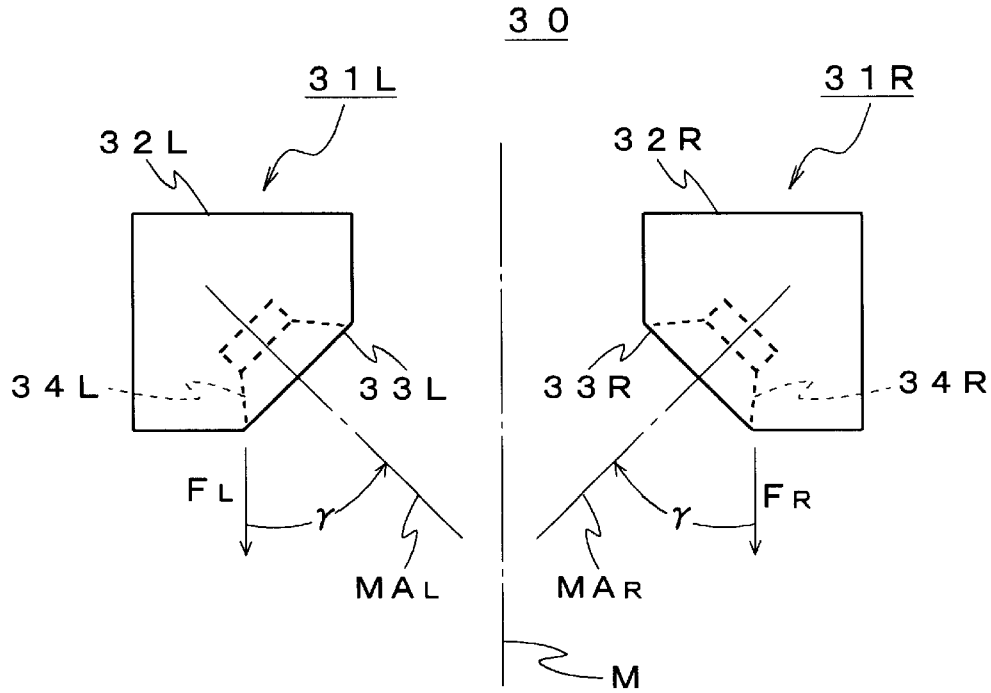
FIG. 9 is a diagram showing directions of principal axes of speakers for reproducing sound signals in the speaker device shown by FIG. 8.

A speaker box 32L constituting the speaker device 31L is formed with a speaker attaching face 33L between a front face and a right side face and the speaker attaching face 33L is attached with a sound signal reproducing speaker 34L. In this case, as shown by FIG. 9, the speaker 34L is attached to the speaker box 32L such that a principal axis MAL thereof is inclined by a predetermined angle γ, for example, 40° through 50°, in the counterclockwise direction relative to a front direction $F_L$ of the speaker box 32L.

A sound wave radiation port (opening portion) 36L covered with an acoustic resistance material 35L is installed at an end face (upper face in the drawing) different from the speaker attaching face 33L of the speaker box 32L. The sound wave radiation port 36L intends to radiate air vibration produced from a rear face of a diaphragm of the speaker 34L to the outside as sound wave and is formed such that an axis penetrating the center thereof is extended in the direction of the principal axis (reference axis) of the speaker 34L.

In this case, an acoustic low pass filter is constituted by acoustic capacitance provided by air in the speaker box 32L and acoustic resistance and acoustic mass of the sound wave radiation port 36L. Further, the group delay time in the pass band of the sound wave radiated from the sound wave radiation port 36L via the low pass filter is utilized and then the speaker device 31L is provided with a directivity provided by a combination of omnidirectionality and bidirectionality in which synthesized sound pressure of sound waves radiated from two sound sources of the front face of the speaker 34L and the sound wave radiation port 36L is provided with a maximum sensitivity on the front principal axis of the speaker 34L.

Further, a speaker box 32R constituting the speaker device 31R is formed with a speaker attaching face 33R between a front face and a left side face thereof and the speaker attaching face 33R is attached with a sound signal reproducing speaker 34R. In this case, as shown by FIG. 9, the speaker 34 is attached to the speaker box 32R such that a principal axis $MA_R$ is inclined by the predetermined angle γ, for example, by 40° through 50° in the clockwise direction relative to a front direction $F_R$ of the speaker box 32R.

A sound radiation port (opening portion) 36R in a circular shape covered with an acoustic resistance material 35R is installed at an end face (upper face in the drawing) different from the speaker attaching face 33R of the speaker box 32R. The sound wave radiation port 36R intends to radiate the vibration produced at a rear face of a diaphragm of the speaker 34R to the outside as sound wave and is formed such that an axis penetrating the center thereof is extended in a direction of the principal axis (reference axis) of the speaker 34R. Thereby, similar to the above-described speaker device 31L, the speaker device 31R is provided with a directivity provided by a combination of omnidirectionality and bidirectionality in which synthetic sound pressure of sound waves radiated from two sound sources of the front face of the speaker 34R and the sound wave radiation port 36R is provided with a maximum sensitivity on the front principal axis of the speaker 34R.

In this case, the principle of providing the directionality provided by the combination of omnidirectionality and bidirectionality as mentioned above to the speaker devices 31L and 31R is similar to that of the speaker device 20 shown by FIG. 1 and accordingly, an explanation thereof will be omitted.

According to the stereophonic speaker device 30 shown by FIG. 8, the principal axes $MA_L$ and $MA_R$ of the sound signal reproducing speakers 34L and 34R are respectively inclined by the predetermined angle γ in the counterclockwise direction and the clockwise direction relative to the front directions $F_L$ and $F_R$ of the speaker boxes 32L and 32R and thus the principal axes $MA_L$ and $MA_R$ of the speakers 34L and 34R are directed inwardly in view of a listening position on the center line M of the speaker devices 31L and 31R (refer to FIG. 9). Further, the speaker devices 31L and 31R are respectively provided with directivities each provided by the combination of bidirectionality and omnidirectionality having maximum sensitivities on the front principal axes of the speakers 34L and 34R.

Figure 28:
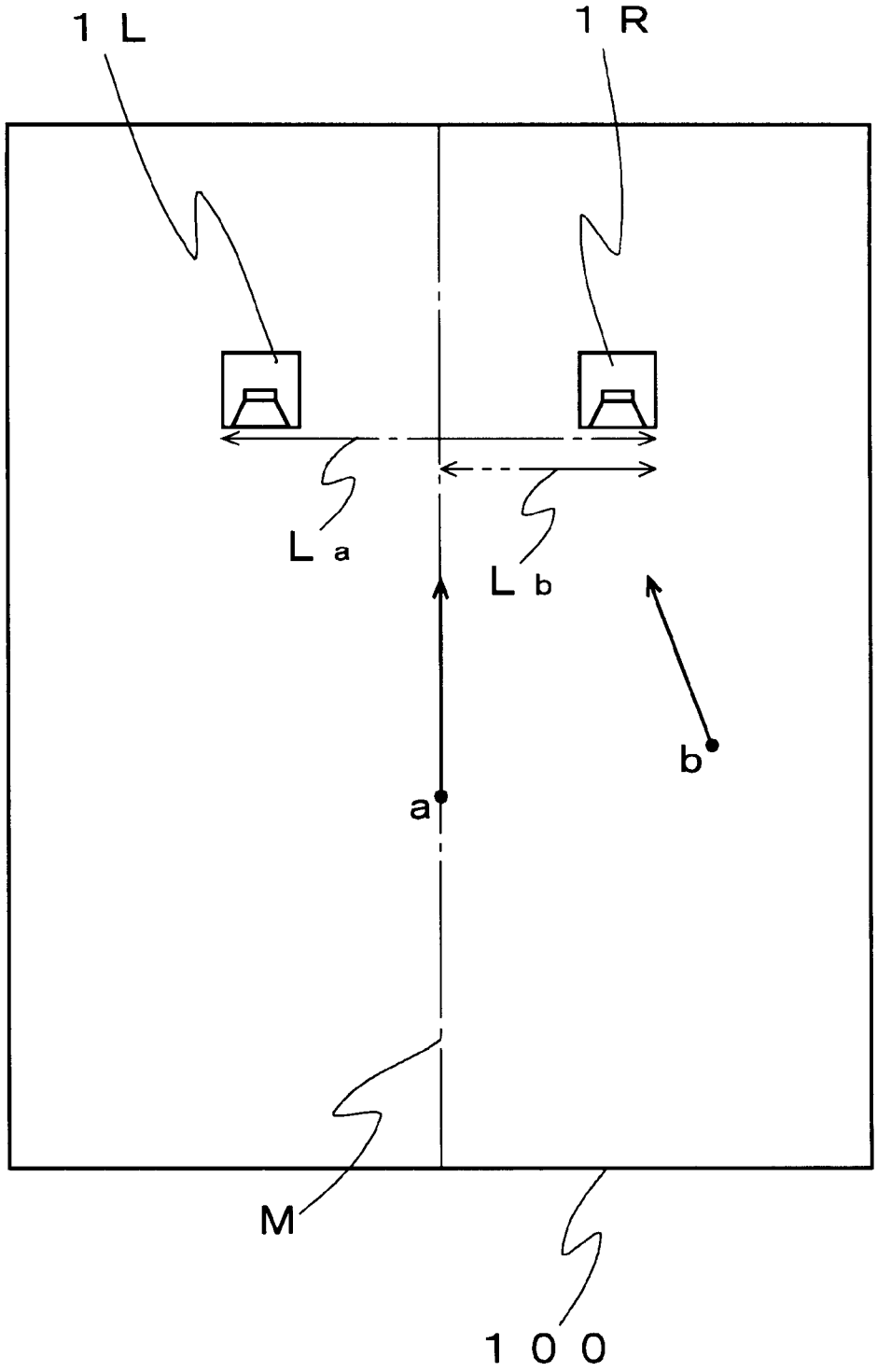
FIG. 28 is a view for explaining a stereophonic speaker device.
Figure 29:
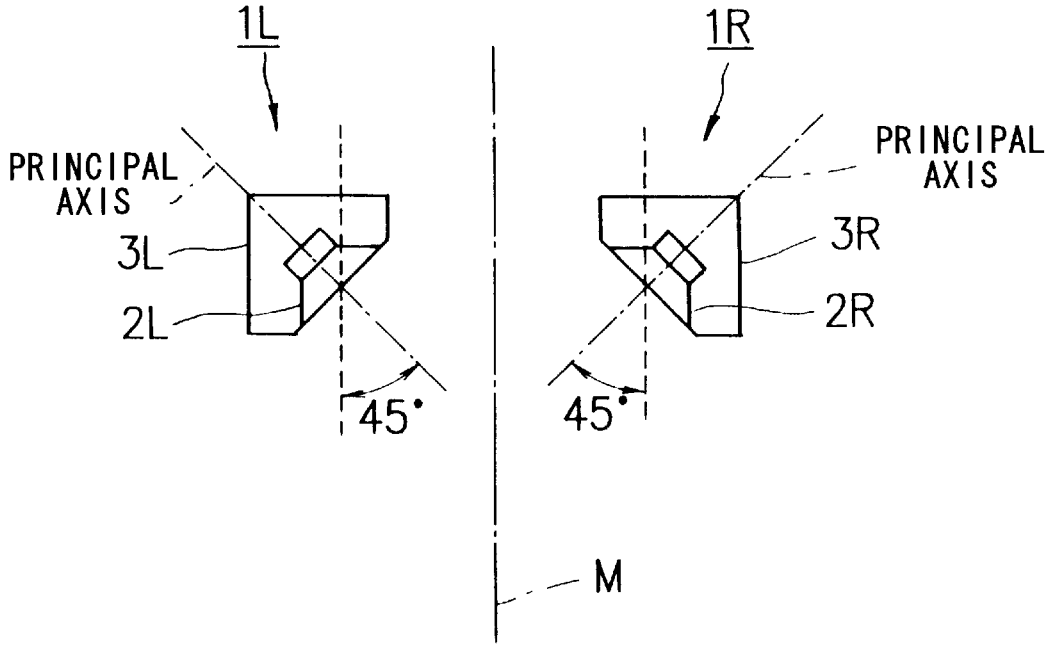
FIG. 29 is a view showing an example of enlarging a listening range providing excellent stereophonic feeling.
Figure 30:
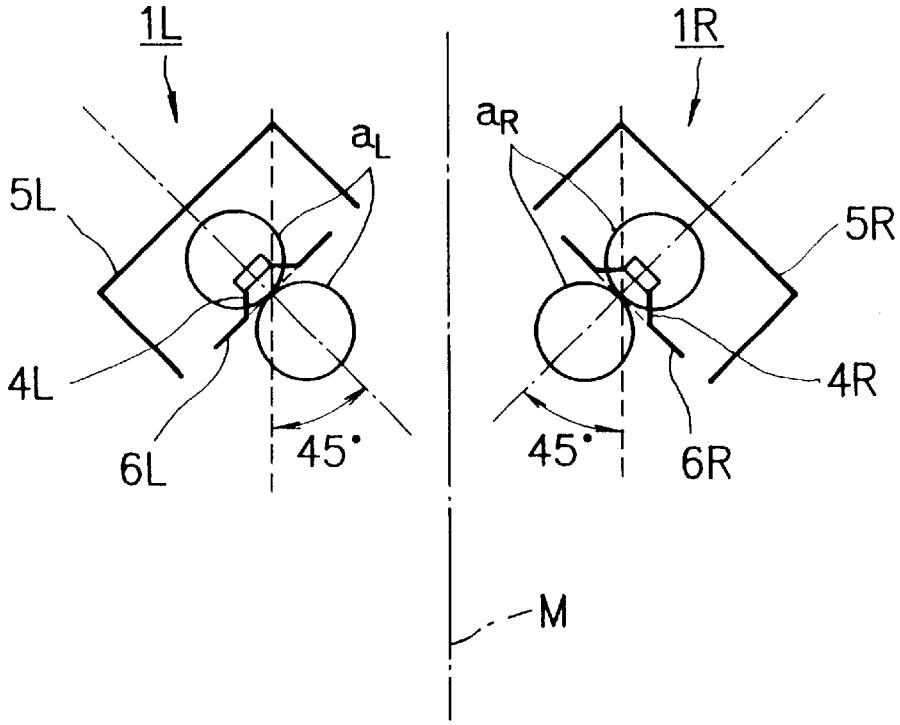
FIG. 30 is a view showing other example for enlarging the listening range for providing excellent stereophonic feeling.

Therefore, at a listening position, for example, at point b (refer to FIG. 28), deviated from the center line M of the speaker devices 31L and 31R, the sound pressure level of the right channel is reduced and the sound pressure level of the left channel is more or less increased and then a difference in the sound levels based on a difference of attenuation in distances of the two left and right channels is corrected. Therefore, according to the stereophonic speaker device 30 shown by FIG. 8, a listening range providing excellent stereophonic feeling can be enlarged.

Figure 10:
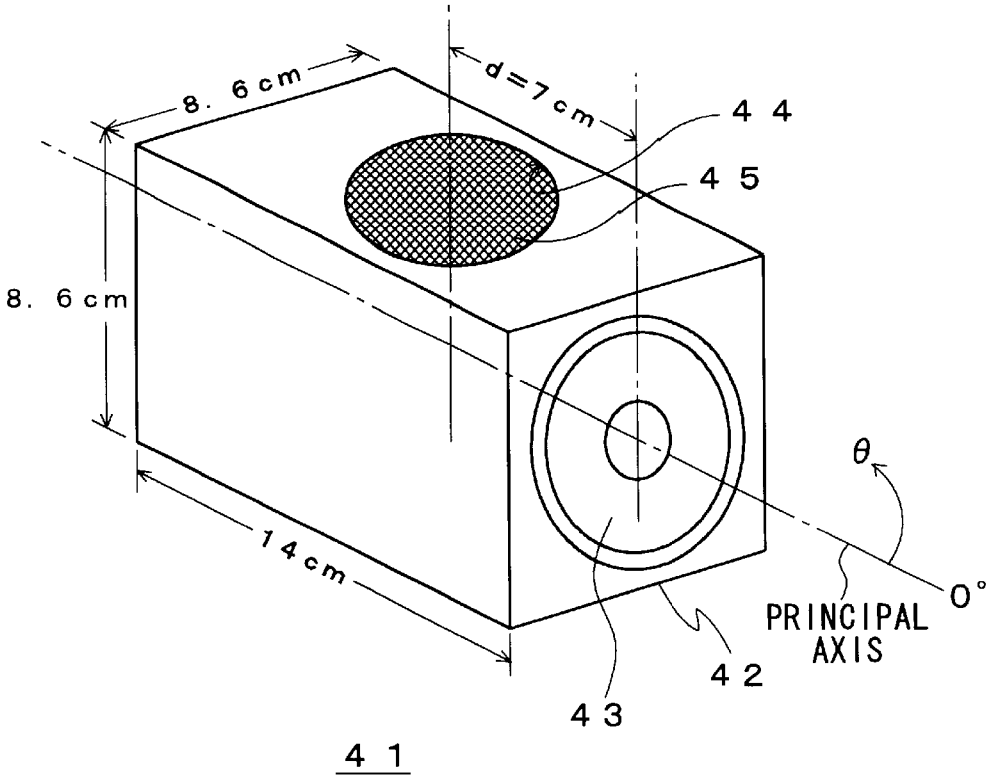
FIG. 10 is a perspective view showing a speaker device used in an auditory sensation test of the speaker device shown by FIG. 8.

The applicant has carried out an auditory sensation test in order to confirm that the listening range providing excellent stereophonic feeling as mentioned above is enlarged in the stereophonic speaker device 30 shown by FIG. 8. FIG. 10 shows a speaker device 41 used as a left channel speaker device as well as a right channel speaker device in the auditory sensation test. The speaker device 41 is provided with unidirectionality.

A speaker box 42 is in a shape of a rectangular parallelepiped, and dimensions of a speaker attaching face are 8.6 cm in height and breadth and 4 cm in depth and volume of air in the speaker box is 600 $cm^3$. A dynamic speaker is used as a sound signal reproducing speaker 43, which has an aperture of 8 cm, an effective diameter of a diaphragm of 7 cm and an effective area of 38.5 $cm^2$. A sound wave radiation port 44 is circular and is installed at the upper face of a speaker box 42 and an effective area thereof is 26 $cm^2$. A spatial distance d in the principal axis direction of two sound sources of the front face of the speakers 43 and the sound wave radiation port 44 is set to 7 cm from Equation (15).

Acoustic resistance of an acoustic resistance material 45 of the sound wave radiation port 44 is $r_1$=0.475 (kg/sec) in MKS unit when represented by equivalent mechanical resistance converted into an area of the speaker diaphragm from Equations (2) and (9). Therefore, equivalent mechanical resistance $r_1'$ represented by an effective area of the sound wave radiation port 44 is calculated by Equation (16) as mentioned above when the effective area of the sound wave radiation port 44 is designated by notation $A_1$. Further, the acoustic resistance density (equivalent mechanical resistance per unit area) of the acoustic resistance material 45 of the sound wave radiation port 44 becomes 130.8 (kg/sec·$m^2$) by dividing Equation (16) by $A_1$.

The bold line a, the dot-dash line b and the broken line c of FIG. 7, mentioned above, show the frequency characteristics of the directivity of the output pressure of the speaker device 41 and it is found that the unidirectionality is provided at middle and low frequencies. Further, a reproduction frequency band (reduced by 3 dB) in the front direction (0° direction) falls in a range of 300 Hz through 20 KHz. The frequency at the limit where the speaker per se starts providing directivity is about 1.2 KHz from Equation (13) when the effective diameter of the diaphragm is 7 cm. Accordingly, by setting d=D=7 cm, at frequencies equal to or lower than about 1.5 KHz, the sound pressure level in 90° direction is lowered by about 6 dB and the sound pressure level in 180° direction is lowered by 15 dB through 20 dB respectively relative to the sound pressure level in 0° direction and there is provided the unidirectionality, which is regarded practically sufficient. The bold line d, the dot-dash line e and the broken line f of FIG. 7 show the frequency characteristics of the directivity of the output sound pressure when the sound wave radiation port 44 is not installed and it is omnidirectional at middle and low frequencies.

Figure 11:
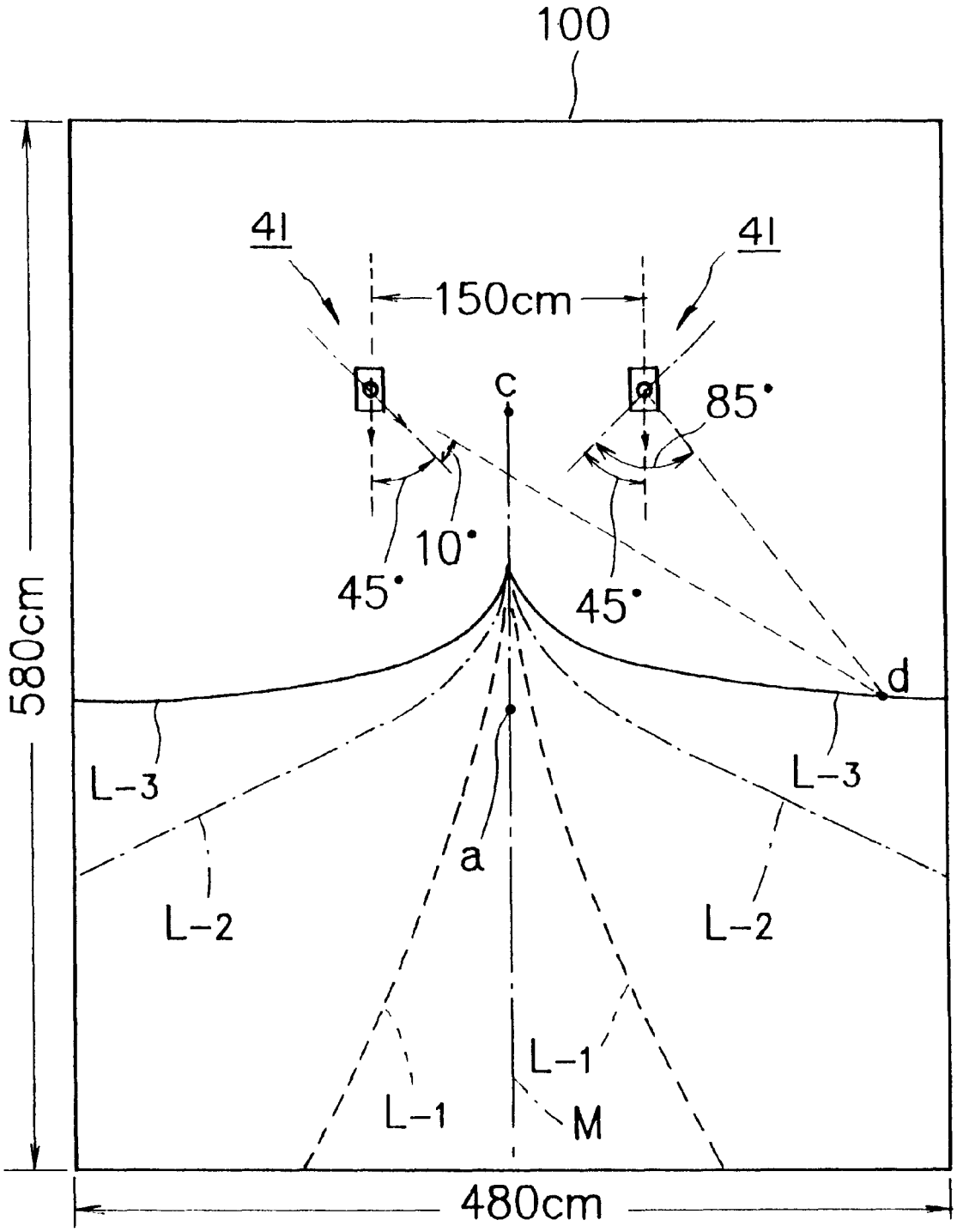
FIG. 11 is a diagram for explaining a result or the like of the auditory sensation test of the speaker device shown by FIG. 8.

An auditory sensation test has been carried out by using the speaker device 41 shown by FIG. 10 as a left channel speaker device and a right channel speaker device and arranging them in the test hearing room 100 having reverberation time of about 0.2 second in a state shown by FIG. 11. In the auditory sensation test, a listening range providing excellent stereophonic feeling is provided by the following method.

That is, when signal sound (for example, vocal or the like) localized in a front central direction at a listening position, for example, at point a, on the central line M of the two speaker devices 41, 41 is localized in a direction of a central position (point c) of the two speaker devices 41, 41 in view from the listening position, continuous sound stage is reproduced between the two speaker devices 41, 41 at the listening position, and excellent stereophonic feeling is provided even at a listening position deviated from the central line M. Hence, in the auditory sensation test, attention is paid to signal sound localized in the front central direction at a listening position, for example, point a, on the center line M of the two speaker devices 41, 41, and then a range in which the signal sound was localized in a direction of a middle position of the two speaker devices 41, 41 at a listening position deviated from the center line M is determined.

In FIG. 11, broken lines $L_{-1}$ show boundaries of a listening range providing excellent stereophonic feeling under condition ① in which the sound wave radiation port 44 of the speaker device 41 is closed to constitute a closed type one and the principle axis of the speaker 43 is directed in the front direction (in parallel with side walls of the test listening room 100), and excellent stereophonic feeling is provided in a range on the center line M from the broken lines $L_{-1}$. Under the condition ①, the listening range providing excellent stereophonic feeling is limited to a narrow range.

Further, dot-dash lines $L_{-2}$ show boundaries of a listening range providing excellent stereophonic feeling under condition ② in which the sound wave radiation port 44 of the speaker device 41 is closed to thereby constitute a closed type one and the principal axis of the speaker 43 is directed inwardly by 45°, and excellent stereophonic feeling is provided in a range on the side of the center line M from the dot-dash lines $L_{-2}$. Under the condition ②, compared with the case of the condition ①, the listening range providing excellent stereophonic feeling is considerably enlarged.

In contrast thereto, bold line $L_{-3}$ show boundaries of a listening range providing excellent stereophonic feeling under condition ③ in which the sound wave radiation port 44 of the speaker device 41 is opened, the frequency range of about 1.5 KHz or lower is made unidirectional and the principal axis of the speaker 43 is directed inwardly by 45°, and excellent stereophonic feeling is provided in a range on the side of the center line M from the bold lines $L_{-3}$. According to the condition ③, compared with the case of the condition ②, the listening range providing excellent stereophonic feeling is further enlarged. The fact shows that the directivity at low frequencies significantly influences on sound image localization at a listening position deviated from the center line M of the two speaker devices 21, 21.

The effect of enlarging the listening range providing excellent stereophonic feeling by such a unidirectionality can be considered as follows. For example, in FIG. 11, although a direction of the speaker device 41 for a left channel at a listening position, for example, at point d, considerably deviated from the center line M of the two speaker devices 41,41, is a direction deviated by 10° from the principal axis of the speaker 43 ($\theta \approx 10°$), the deviation to such a degree may substantially be regarded in a direction of a maximum sensitivity of the speaker device 41.

In contract thereto, a direction of the speaker device 41 for a right channel at the point d is a direction deviated by about 85° from the principal axis of the speaker 43 ($\theta \approx 85°$). Therefore, the sensitivity of the speaker device 41 for the right channel becomes 0.55, which is lowered by 5.2 dB from the maximum sensitivity (=1), in view from the directivity pattern of the unidirectionality (cardioid) of FIG. 4. The lowering of the sound pressure level by the directivity is considered to perform excellent sound image localization even at the point d.

Considering in this way, in the case of hyper cardioid, the sensitivity at $\theta \approx 85°$ becomes 0.38, which is lowered by 8.4 dB from the maximum sensitivity (refer to FIG. 4), and the case of hyper cardioid may be regarded to be more effective in enlarging the listening range than unidirectionality (cardioid).

Although a ratio of components of bidirectionality and omnidirectionality in the case of the unidirectionality (cardioid) is 1:1, the above-described component ratio is 1:0.5 in the case of hyper cardioid, and the bidirectional component is twice as much as the omnidirectional component therein. However, in the case of directivity in which the component ratio of the bidirectional component becomes higher than that, the low frequency limit of the reproduction band is narrowed and accordingly, in a practical point of view, the directivity having the directivity pattern in a range from the unidirectionality (cardioid) to hyper cardioid is pertinent.

Further, in respect of the angle by which the principal axes of the speakers 43 are directed inward from the two speaker devices 41, 41, when the speakers are excessively directed inwardly, for example, in the case in which listening is carried out at the point d of FIG. 11, the sound level of the speaker device 41 for the right channel is considerably lowered at a high frequency region owing to the directivity which is dependent on the diameter of the speaker diaphragm, and accordingly, there results sound quality deficient of high frequencies. Accordingly, in view from both of the effect of enlarging the listening range and the sound quality, the angle directed inwardly is pertinent in the range of 40° through 50°.

Figure 12:
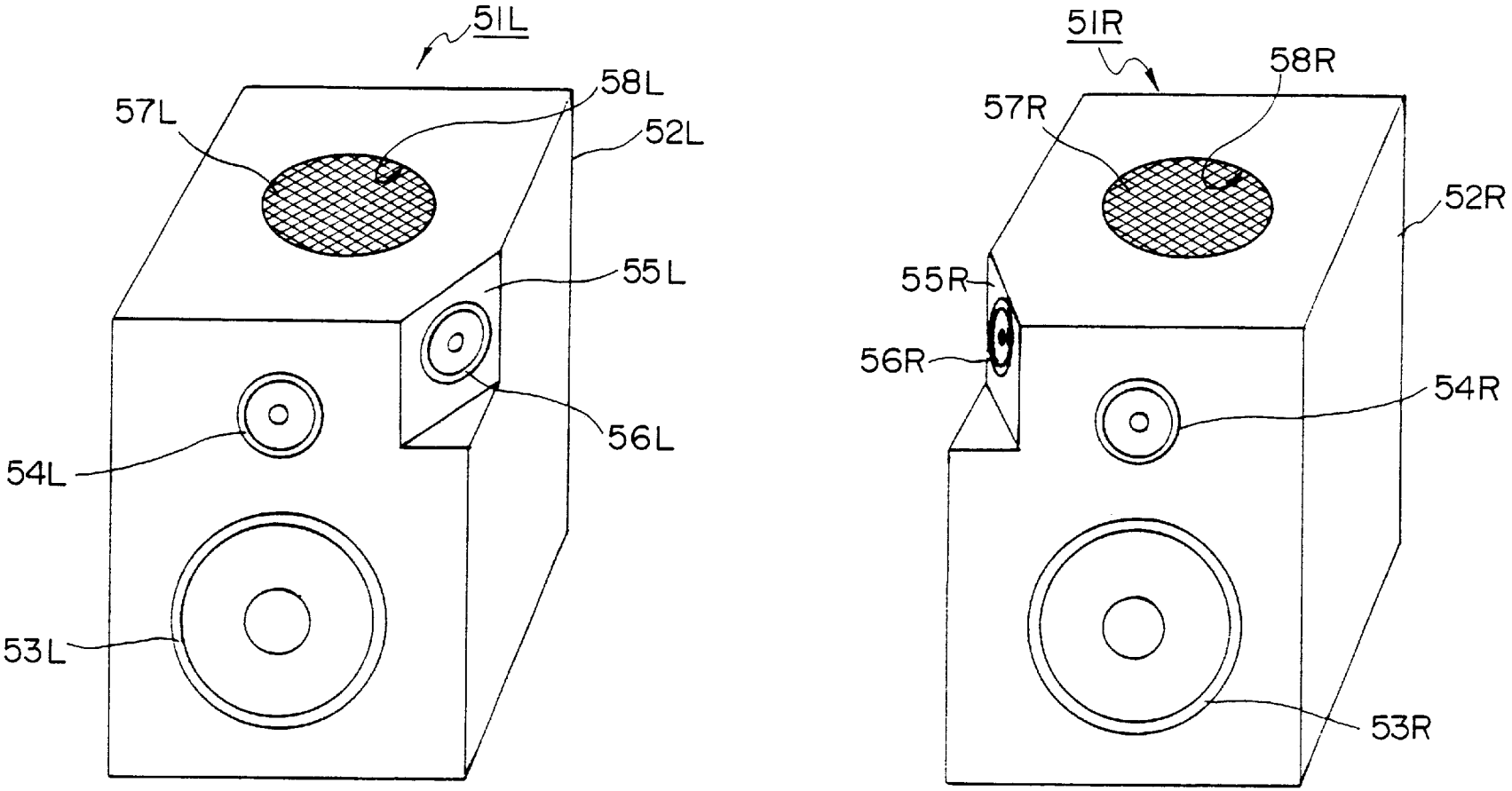
FIG. 12 is a perspective view showing a stereophonic speaker device according to the present invention.

Next, FIG. 12 shows a stereophonic speaker device 50 as still another best mode. The speaker device 50 is constituted by a left channel speaker device 51L and a right channel speaker device 51R.

Figure 13:
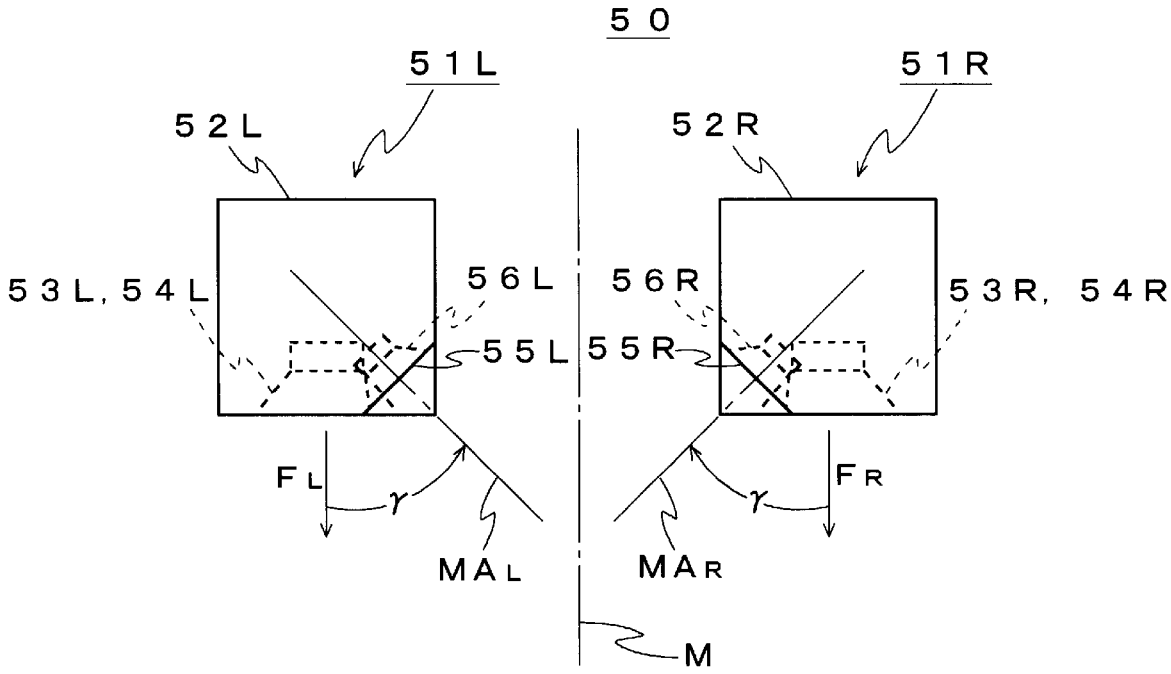
FIG. 13 is a diagram showing directions of principal axes of speakers for reproducing sound signals in the speaker device shown by FIG. 12.

The speaker device 51L is of a 2-way system in which a woofer 53L and a tweeter 54L constituting sound signal reproducing speakers are attached at a front face of a speaker box 52L substantially in a shape of a rectangular parallelepiped. The woofer 53L and the tweeter 54L are attached to a front face side of the speaker box 52L such that principal axes of the woofer 53L and the tweeter 54L are directed in the front direction of the speaker box 52L. Further, the speaker box 52L is formed with a speaker attaching face 55L by cutting off an upper portion of a corner constituted by a front face and a right side face thereof and the attaching face 55L is attached with a sound signal reproducing speaker 56L. In this case, as shown by FIG. 13, the speaker 56L is attached to the speaker box 52L such that a principal axis $MA_L$ is inclined by a predetermined angle γ, for example, by 40° through 50°, in the counterclockwise direction relative to a front direction $F_L$ of the speaker box 52L.

Further, a sound wave radiation port (opening portion) 58L in a circular shape covered with an acoustic resistance material 57L is installed at an end face (upper face in the drawing) different from the speaker attaching face 55L of the speaker box 52L. The sound wave radiation port 58L intends to radiate air vibration produced by a rear face of a diaphragm of the speaker 56L and is formed such that an axis penetrating the center is extended in a direction of the principal axis of the speaker 56L. Although not mentioned above, at inside of the speaker box 52L, a box portion where the speaker 56L is attached is partitioned from other box portion.

In this case, an acoustic low pass filter is constituted by acoustic capacitance provided by air in the box portion attached with the speaker 56L of the speaker box 52L and the acoustic resistance and acoustic mass of the sound wave radiation port 58L. Further, group delay time in a pass band of sound wave radiated from the sound wave radiation port 58L via the low pass filter is utilized and a speaker portion constituted by the speaker 56L of the speaker device 51L is provided with a directivity provided by a combination of omnidirectionality and bidirectionality such that synthesized sound pressure of sound waves radiated from two sound sources of the front face of the speaker 56L and the sound wave radiation port 58L is provided with a maximum sensitivity on the front principal axis of the speaker 56L.

The speaker device 51R is of a 2-way system attached with a woofer 53R and a tweeter 54R constituting sound signal reproducing speakers at a front face of the speaker box 52R substantially in a shape of a rectangular parallelepiped. The woofer 53R and the tweeter 54R are attached to the front face side of the speaker box 52R such that principal axes thereof are directed in the front direction of the speaker box 52R. Further, the speaker box 52R is formed with a speaker attaching face 55R by cutting off an upper portion of a corner constituted by a front face and a left side face thereof and the attaching face 55R is attached with a sound signal reproducing speaker 56R. In this case, as shown by FIG. 13, the speaker 56R is attached to the speaker box 52R such that a principal axis $MA_R$ thereof is inclined by the predetermined angle γ, for example, by 40° through 50°, in the clockwise direction relative to a front direction $F_R$ of the speaker box 52R.

Further, a sound wave radiation port (opening portion) 58R in a circular shape covered with an acoustic resistance material 57R is installed at an end face (upper face in the drawing)different from the speaker attaching face 55R of the speaker box 52R. The sound wave radiation port 58R intends to radiate air vibration produced by a rear face of a diaphragm of the speaker 56R to the outside as sound wave and is formed such that an axis penetrating the center thereof is extended in the direction of the principal axis of the speaker 56R. Although not mentioned above, at inside of the speaker box 52R, a box portion attached with the speaker 56R is partitioned by other box portion.

In this case, an acoustic low pass filter is constituted by acoustic capacitance produced by air in the box portion attached with the speaker 56R of the speaker box 52R and acoustic resistance and acoustic mass of the sound wave radiation port 58R. Further, group delay time in a pass band of sound wave radiated from the sound wave radiation port 58R via the low pass filter is utilized and a speaker portion constituted by the speaker 56R of the speaker device 51R is provided with a directivity provided by a combination of omnidirectionality and bidirectionality such that synthesized sound pressure of sound waves radiated from two sound sources of the front face of the speaker 56R and the sound wave radiation port 58R is provided with a maximum sensitivity on the front principal axis of the speaker 56R.

According to the stereophonic speaker device 50 shown by FIG. 12, the principal axes $MA_L$ and $MA_R$ of the sound signal reproducing speakers 56L and 56R are inclined by the predetermined angle γ respectively in the counterclockwise direction and the clockwise direction relative to the front directions $F_L$ and $F_R$ of the speaker boxes 52L and 52R, and then the principal axes $MA_L$ and $MA_R$ of the speakers 56L and 56R are respectively directed inwardly in view from a listening position on the center line M of the speaker devices 51L and 51R (refer to FIG. 13). Further, the speaker portions constituted by the speakers 56L and 56R of the speaker devices 51L and 51R are provided with directivities each provided by the combination of bidirectionality and omnidirectionality having a maximum sensitivity on the front principal axis of each of the speakers 56L and 56R.

Therefore, at a listening position, for example, at point b (refer to FIG. 28), deviated from the center line M of the speaker devices 51L and 51R, a sound pressure level of a right channel is reduced and a sound pressure level of a left channel is more or less increased and then a difference in the sound pressure levels based on a difference in attenuation of sound in distances to the two left and right channels is corrected. Therefore, according to the stereophonic speaker device 50 shown by FIG. 12, a listening range providing excellent stereophonic feeling can be enlarged similar to the stereophonic speaker device 30 shown by FIG. 8.

Figure 14:
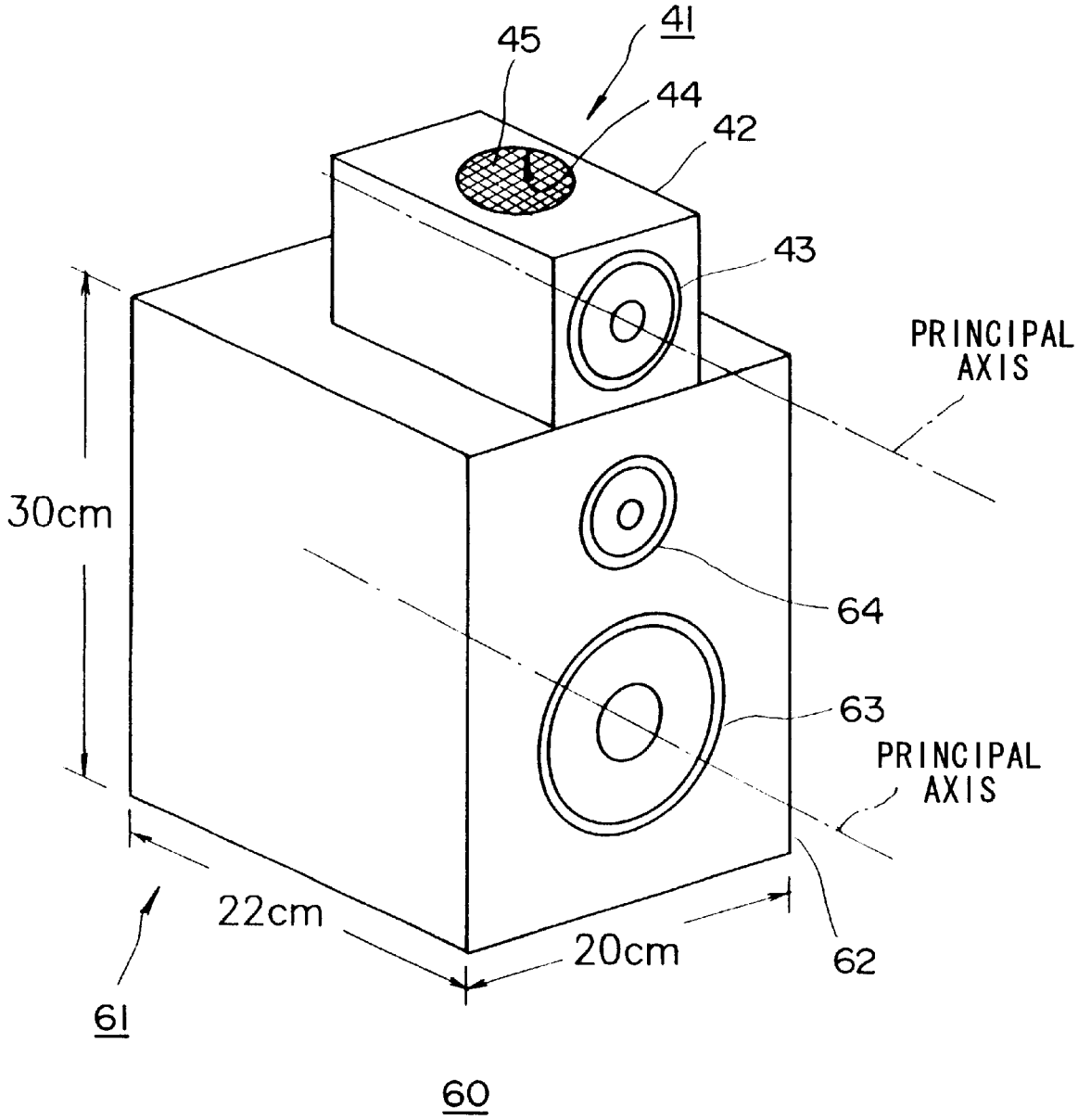
FIG. 14 is a perspective view showing a speaker device used in an auditory sensation test of the speaker device shown by FIG. 12.

The applicant has carried out an auditory sensation test in order to confirm that the listening range providing excellent stereophonic feeling is enlarged in the stereophonic speaker device 50 shown by FIG. 12 as mentioned above. FIG. 14 shows a speaker device 60 used as a left channel speaker device and a right channel speaker device in the auditory sensation test. The speaker device 60 is arranged with the speaker device 41 shown by FIG. 10 on a speaker device 61. The speaker device 61 is of a 2-way system in which a woofer 63 having an aperture of 14 cm and a tweeter 64 having an aperture of 8 cm, for reproducing sound signal are attached to a speaker box 62 of lateral width=20 cm, depth=22 cm and height=30 cm.

Figure 15:
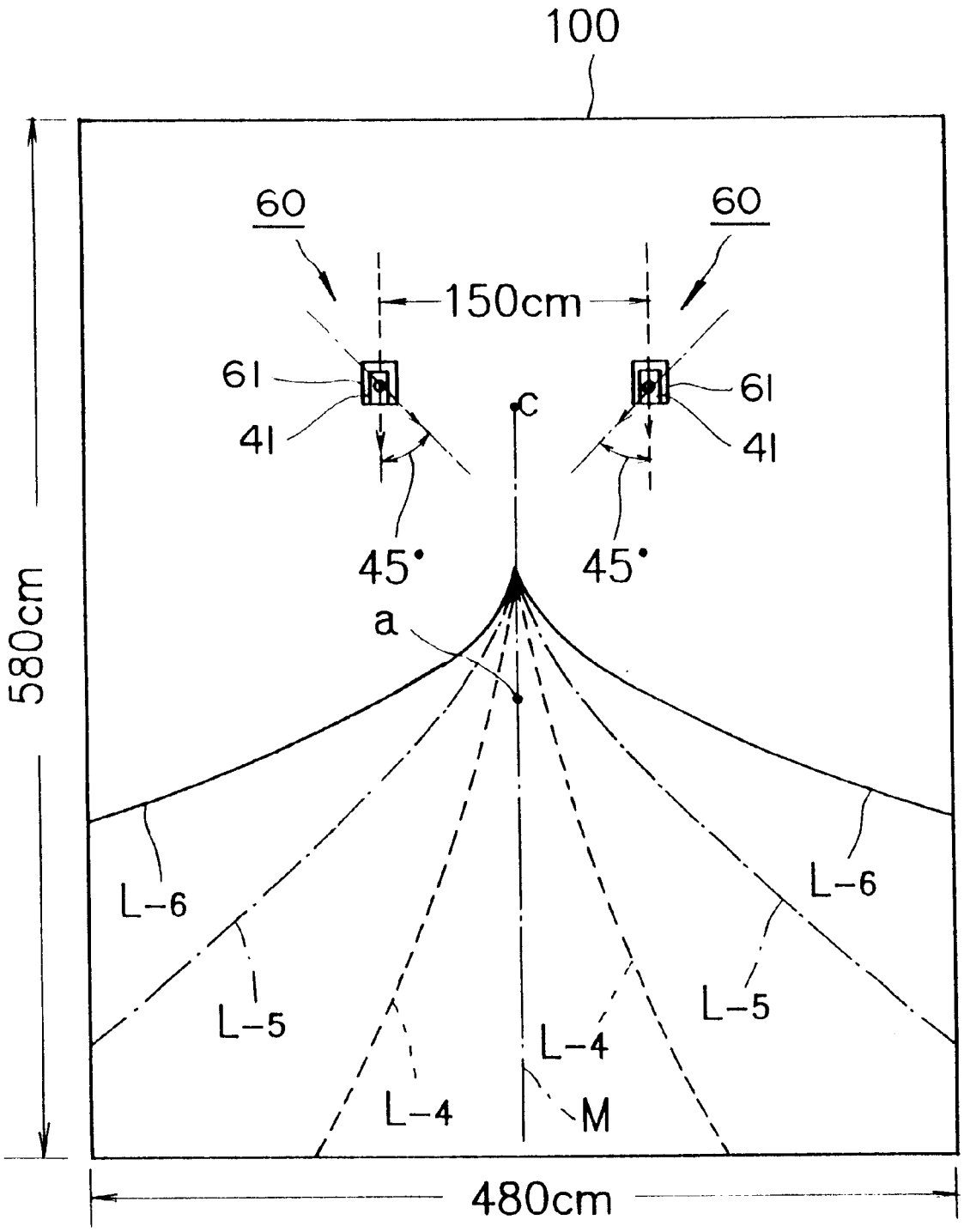
FIG. 15 is a diagram for explaining a result or the like of the auditory sensation test of the speaker shown by FIG. 12.

The auditory sensation test has been carried out by using the speaker device 60 shown by FIG. 14 as the left channel speaker device and as the right channel speaker device and arranging them in the test listening room 100 having reverberation time of about 0.2 second in a state shown by FIG. 15. In this case, by a method similar to that in the case of FIG. 11, a listening range providing excellent stereophonic feeling is determined. Further, the speaker device 61 of the 2-way system is arranged such that the principal axes of the woofer 63 and the tweeter 64 are directed in the front direction (in parallel with side walls of test listening room 100). Further, in a state in which the principal axis of the speakers 43 of the speaker device 41 is directed in the front direction, a sound pressure level at a listening portion, for example, at point a, on the center line M of the two speaker devices 60, 60 of the speaker device 41 is set to be lower than a sound pressure level of the speaker device 61 of the 2-way system by 3 dB.

In FIG. 15, broken lines $L_{-4}$ show boundaries of the listening range providing excellent stereophonic feeling under the condition ④ in which the sound wave radiation port 44 of the speaker device 41 is closed to thereby constitute a closed type one and the principal axis of the speaker 43 is directed in the front direction, and thus, excellent stereophonic feeling is provided within a range on the side of the center line M from the broken lines $L_{-4}$. Under the condition ④ the listening range providing excellent stereophonic feeling is restricted to a narrow range similar to the case of the condition ① of FIG. 11.

Further, dot-dash lines $L_{-5}$ show boundaries of the listening range providing excellent stereophonic feeling under the condition ⑤ in which the sound wave radiation port 44 of the speaker device 41 is closed to thereby constitute a closed type one and the principal axis of the speaker 43 is directed inwardly by 45°, and excellent stereophonic feeling is provided within a range on the side of the center line M from the dot-dash lines $L_{-5}$. Although the listening range providing excellent stereophonic feeling is considerably enlarged under the condition ⑤, as compared with the case of condition ④, the listening range is more or less narrower than that in the case of the condition ② of FIG. 11.

In contrast thereto, bold lines $L_{-6}$ show boundaries of the listening range providing excellent stereophonic feeling under condition ⑥ in which the sound wave radiation port 44 of the speaker device 41 is opened, unidirectionality is constituted in a frequency range of about 1.5 KHz or lower and the principal axis of the speaker 43 is directed inwardly by 45°, and excellent stereophonic feeling was determined within a range on the side of the center line M from the bold lines $L_{-6}$.

Under the condition ⑥, compared with the case of the condition ⑤, the listening range providing excellent stereophonic feeling is further enlarged. It can say that, although the listening range is more or less narrower than that in the case of the condition ③ of FIG. 11, a significant effect is achieved in enlarging the listening range providing preferable stereophonic feeling by adding sound waves radiated from the small-sized unidirectional speaker devices 41 to sound waves radiated from the speaker devices 61 of the 2-way system directed in the front direction under the above-described pressure level condition.

In this case, in respect of the directivity of the added speaker device 41, the directivity having the directivity pattern in a range from the cardioid to hyper cardioid is suitable as mentioned above. Further, in respect of the angle of setting the principal axis of the directivity speaker, the device is suitable to direct inwardly in a range of 40° through 50°.

As mentioned above, according to the stereophonic speaker devices 30 and 50 shown by FIG. 8 and FIG. 12, the principal axes of the sound signal reproducing speakers of the speaker devices of the left channel and the right channel are directed inwardly in view from a listening position on the center line of the two speaker devices and the speaker portions constituted by the sound signal reproducing speakers of the two speaker devices are provided with directivities each provided by a combination of bidirectionality and omnidirectionality. Accordingly, at a listening position deviated from the center line of the two speaker devices, a difference in sound pressure levels based on a difference in attenuation of sound in distances to both left and right channels is corrected and the listening range providing excellent stereophonic feeling can be enlarged. Further, the speaker portions constituted by the sound signal reproducing speakers of the two speaker devices are provided with directivities each provided by a combination of bidirectionality and omnidirectionality and then the directivity can be provided by utilizing group delay time of sound wave radiated from, for example, the sound wave radiation port. Accordingly, there is achieved a merit capable of downsizing the system constitution, compared with the conventional case in which the directivity provided by a speaker per se is utilized or a bidirectional speaker is utilized.

Figure 16:
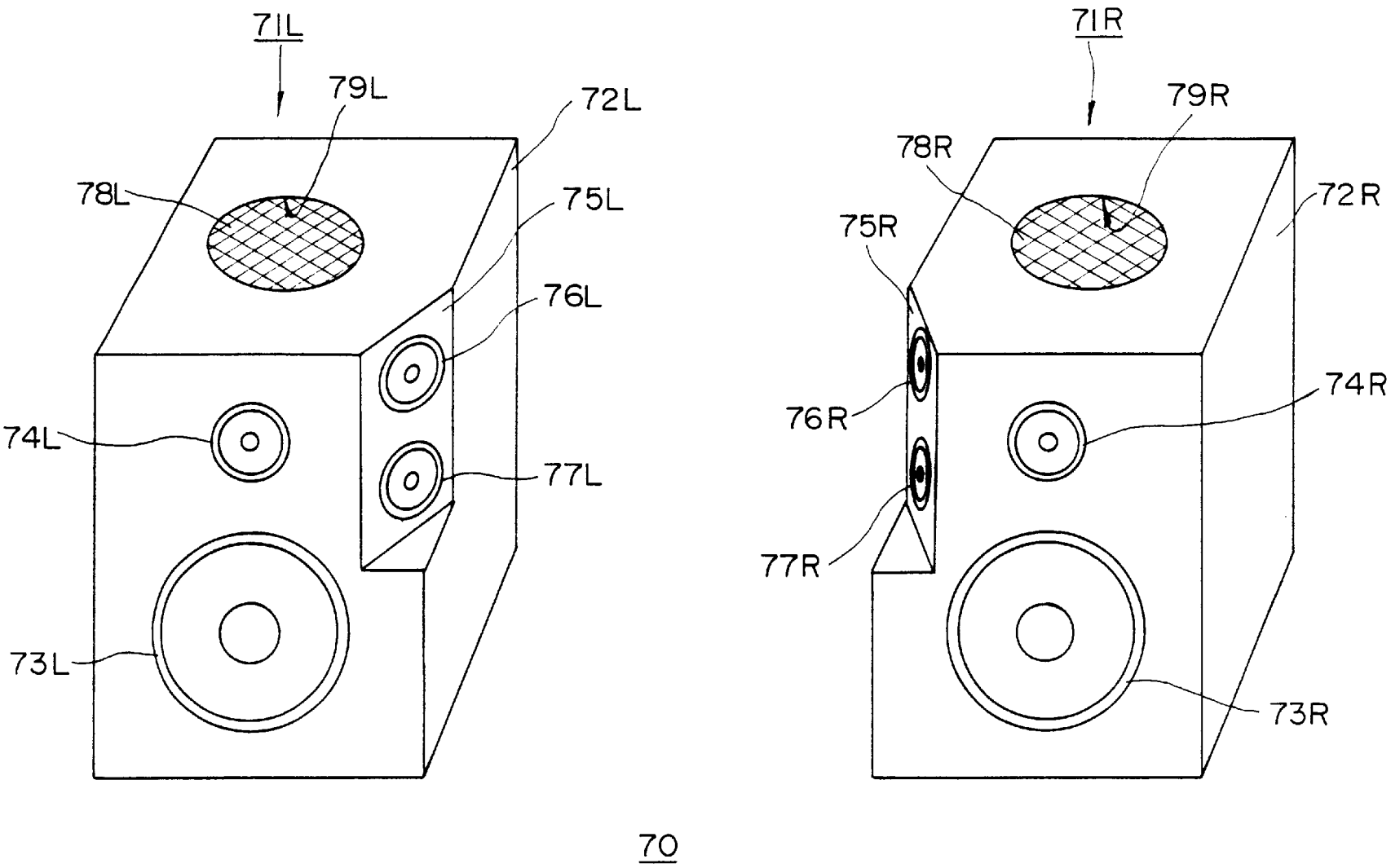
FIG. 16 is a perspective view showing a stereophonic speaker device according to the present invention.

Next, FIG. 16 shows a stereophonic speaker device 70 as further best mode. The speaker device 70 is constituted by a left channel speaker device 71L and a right channel speaker device 71R.

Figure 17:
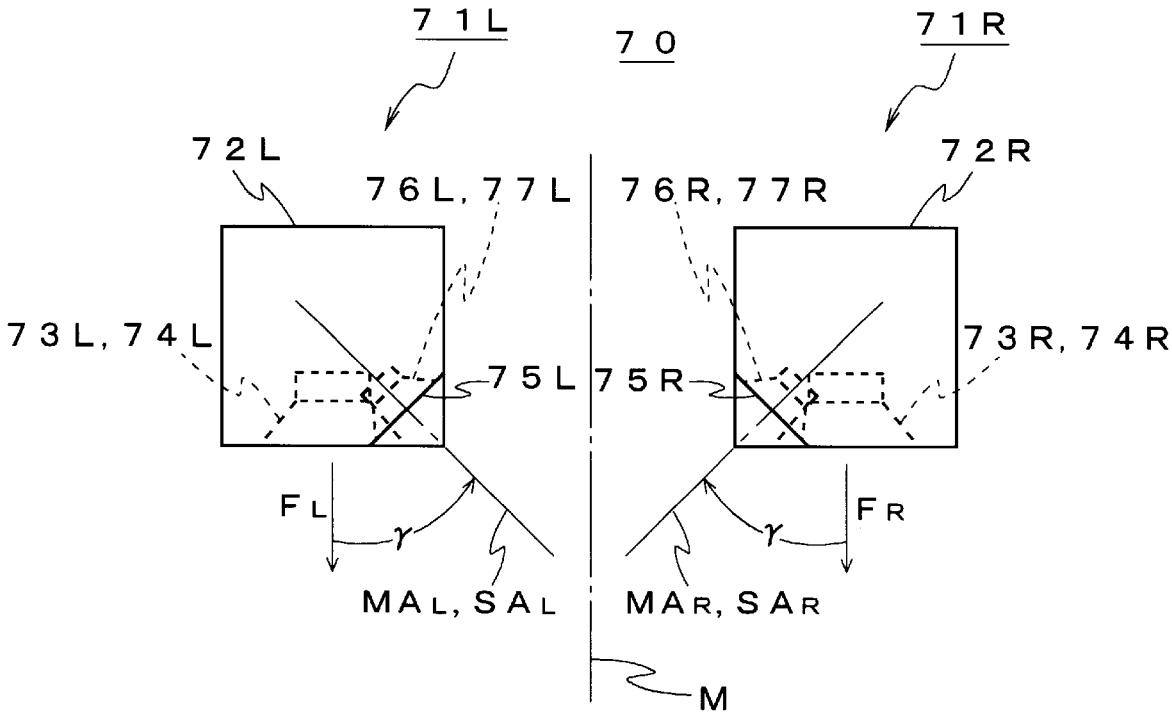
FIG. 17 is a view showing directions of principal axes of speakers for reproducing sound signals and a surround signal of the speaker device shown by FIG. 16.

The speaker device 71L is of a 2-way system in which a woofer 73L and a tweeter 74L constituting sound signal reproducing speakers are attached to a front face of a speaker box 72L substantially in a shape of a rectangular parallelepiped. The woofer 73L and the tweeter 74L are attached to the front face side of the speaker box 72L such that principal axes thereof are directed in the front direction of the speaker box 72L. Further, the speaker box 72L is formed with a speaker attaching face 75L by cutting off an upper portion of a corner constituted by a front face and a right side face thereof and the attaching face 75L is attached with a sound signal reproducing speaker 76L and a surround signal reproducing speaker 77L. In this case, as shown by FIG. 17, the speakers 76L and 77L are attached to the speaker box 72L such that principal axes $MA_L$ and $SA_L$ are inclined by a predetermined angle γ, for example, 40° through 50°, in the counterclockwise direction relative to the front direction of the speaker box 72L.

Further, a sound wave radiation port (opening portion) 79L in a circular shape covered with acoustic resistance material 78L is installed at an end face (upper face in the drawing) different from the speaker attaching face 75L of the speaker box 72L. The sound wave radiation port 79L intends to radiate air vibration produced by a rear face of a diaphragm of the speaker 76L to the outside as sound wave and is formed such that an axis penetrating the center thereof is extended in a direction of the principal axis of the speaker 76L. Although not illustrated, at inside of the speaker box 72L, a box portion attached with the speaker 76L is partitioned from other box portion.

In this case, an acoustic low pass filter is constituted by acoustic capacitance provided by air in the box portion attached with the speaker 76L of the speaker box 72L and acoustic resistance and acoustic mass of the sound wave radiation port 79L. Further, group delay time in a pass band of sound wave radiated from the sound wave radiation port 79L via the low pass filter is utilized and the speaker portion constituted by the speaker 76L of the speaker device 71L is provided with a directivity provided by a combination of omnidirectionality and bidirectionality in which synthesized sound pressure of sound waves radiated from two sound sources of the front face of the speaker 76L and the sound radiation port 79L is provided with a maximum sensitivity on the front principal axis of the speaker 76L.

The speaker device 71R is of a 2-way system in which a woofer 73R and a tweeter 74R constituting sound signal reproducing speakers are attached to a front face of a speaker box 72R substantially in a shape of a rectangular parallelepiped. The woofer 73R and the tweeter 74R are attached to the front face side of the speaker box 72R such that principal axes thereof are directed in the front direction of the speaker box 72R. Further, the speaker box 72R is formed with a speaker attaching face 75R by cutting off an upper portion of a corner constituted by a front face and a left side face thereof and the attaching face 75R is attached with a sound signal reproducing speaker 76R and a surround signal reproducing speaker 77R. In this case, as shown by FIG. 17, the speaker 76R is attached to the speaker box 72R such that principal axes $MA_R$ and $SA_R$ are inclined by the predetermined angle γ, for example, by 40° through 50°, in the clockwise direction relative to the front direction $F_R$ of the speaker box 72R.

Further, a sound wave radiation port (opening portion) 79R in a circular shape covered with an acoustic resistance material 78R is installed at an end face(upper face in the drawing) different from the speaker attaching face 75R of the speaker box 72R. The sound wave radiation port 79R intends to radiate air vibration produced by a rear face of a diaphragm of the speaker 76R to the outside as sound wave and is formed such that an axis penetrating the center thereof is extended in a direction of the principal axis of the speaker 76R. Although not mentioned above, at inside of the speaker box 72R, a box portion attached with the speaker 76R is partitioned from other box portion.

In this case, an acoustic low pass filter is constituted by acoustic capacitance provided by air in the box portion attached with the speaker 76R of the speaker box 72R and acoustic resistance and acoustic mass of the sound wave radiation port 79R. Further, group delay time in a pass band of sound wave radiated from the sound wave radiation port 79R via the low pass filter is utilized and thus, the speaker portion constituted by the speaker 76R of the speaker device 71R is provided with a directivity provided by the combination of omnidirectionality and bidirectionality such that synthesized sound pressure of sound waves radiated from two sound sources of the front face of the speaker 76R and the sound wave radiation port 79R is provided with a maximum sensitivity on the front principal axis of the speaker 76R.

In this case, in respect of the principle providing the directivity provided by the combination of omnidirectionality and bidirectionality to the speaker portions respectively constituted by the speakers 76L and 76R of the speaker devices 71L and 71R as mentioned above, the principle is similar to that in the speaker device 20 shown by FIG. 1 and accordingly, an explanation thereof will be omitted.

According to the stereophonic speaker device 70 shown by FIG. 16, the principal axes $MA_L$ and $MA_R$ of the sound signal reproducing speakers 76L and 76R are inclined by the predetermined angle γ respectively in the counterclockwise direction and the clockwise direction relative to the front directions $F_L$ and $F_R$ of the speaker boxes 72L and 72R, and the principal axes $MA_L$ and $MA_R$ of the speakers 76L and 76R are directed inwardly in view from a listening position on the center line of the speaker devices 71L and 71R (refer to FIG. 17). Further, the speaker portions constituted by the speakers 76L and 76R of the speaker devices 71L and 71R are provided with the directivities each provided by the combination of bidirectionality and omnidirectionality having a maximum sensitivity on the front principal axes of each of the speakers 76L and 76R.

Accordingly, at a listening position, for example, at point b (refer to FIG. 28), deviated from the center line M of the speaker devices 71L and 71R, a sound pressure level of a right channel is reduced, a sound pressure level of a left channel is more or less increased, and then a difference in sound pressure levels based on a difference in attenuation of sound in distances to the two left and right channels is corrected. Therefore, according to the stereophonic device 70 shown in FIG. 16, a listening range providing excellent stereophonic feeling can be enlarged.

Further, according to the stereophonic speaker device 70 shown in FIG. 16, the principal axes $SA_L$ and $SA_R$ of the surround signal reproducing speakers 77L and 77R are inclined by the predetermined angle γ respectively in the counterclockwise direction and the clockwise direction relative to the front directions $F_L$ and $F_R$ of the speaker boxes 72L and 72R. Therefore, the principal axes $MA_L$ and $SA_R$ of the speakers 77L and 77R are directed inwardly in view from a listening position on the center line M of the speaker devices 71L and 71R (refer to FIG. 17).

Figure 34:
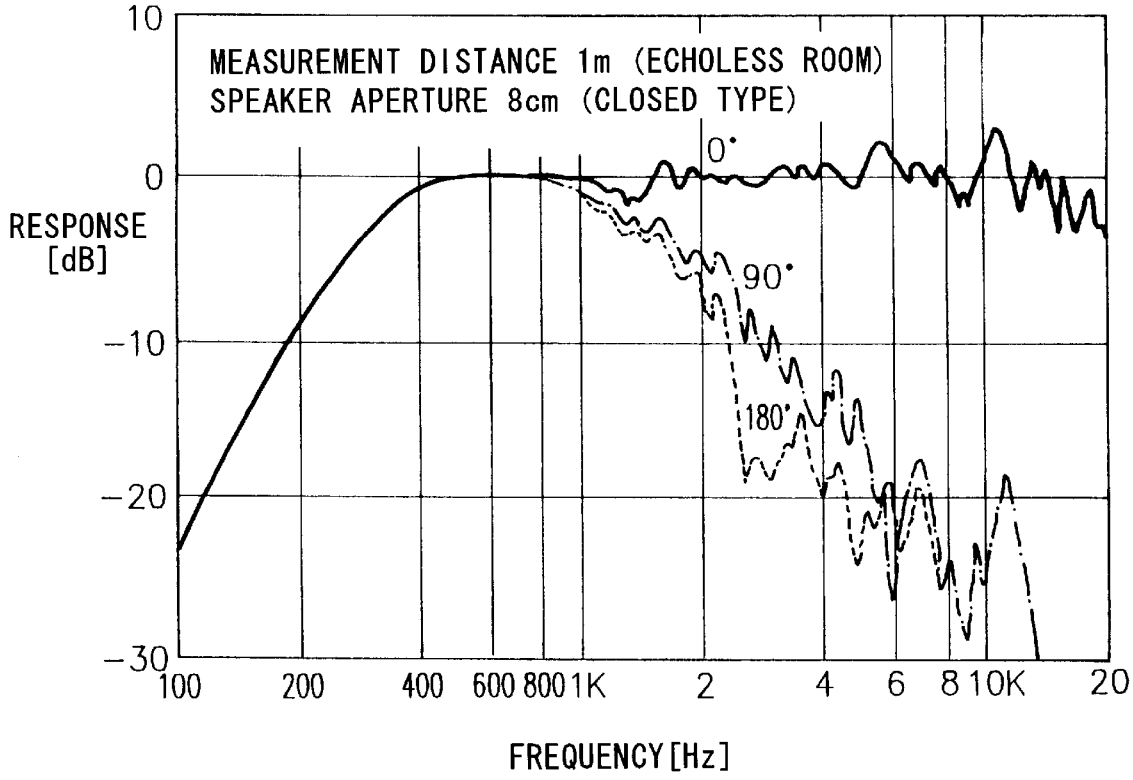
FIG. 34 is a diagram showing an example of a directivity frequency characteristic of output sound pressure of a speaker.

Generally, an S signal component, which is a major component of the surround signal, is a signal having major components at middle and high frequencies. Further, according to the speakers 77L and 77R, the diaphragms are provided with limited areas and accordingly, as shown by FIG. 34, at middle and high frequencies, radiated sound wave per se is provided with a directivity.

Figure 31:
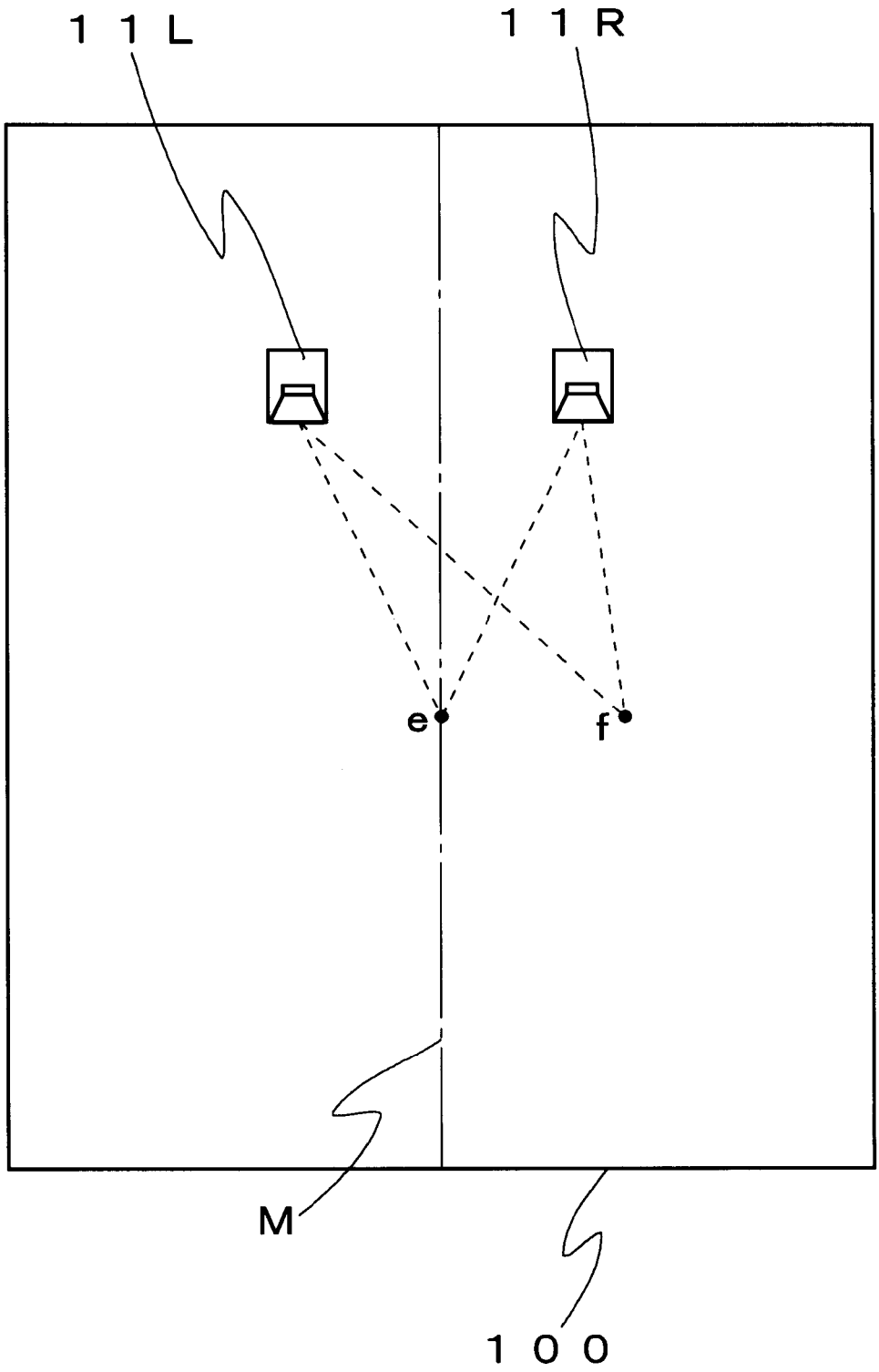
FIG. 31 is a view showing a conventional front surround speaker device.
Figure 32:
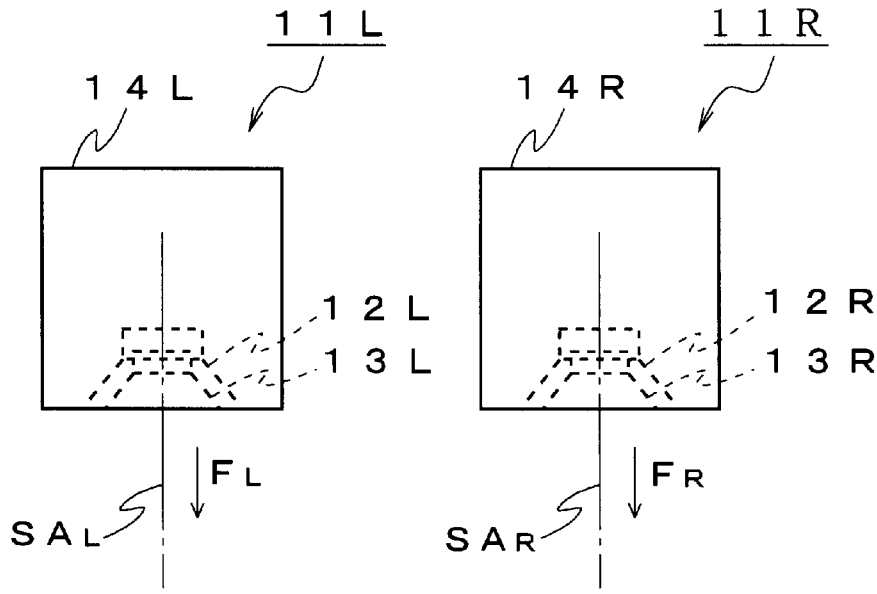
FIG. 32 is a diagram showing an example in which principal axes of surround signal reproducing speakers are directed in front directions.
Figure 33:
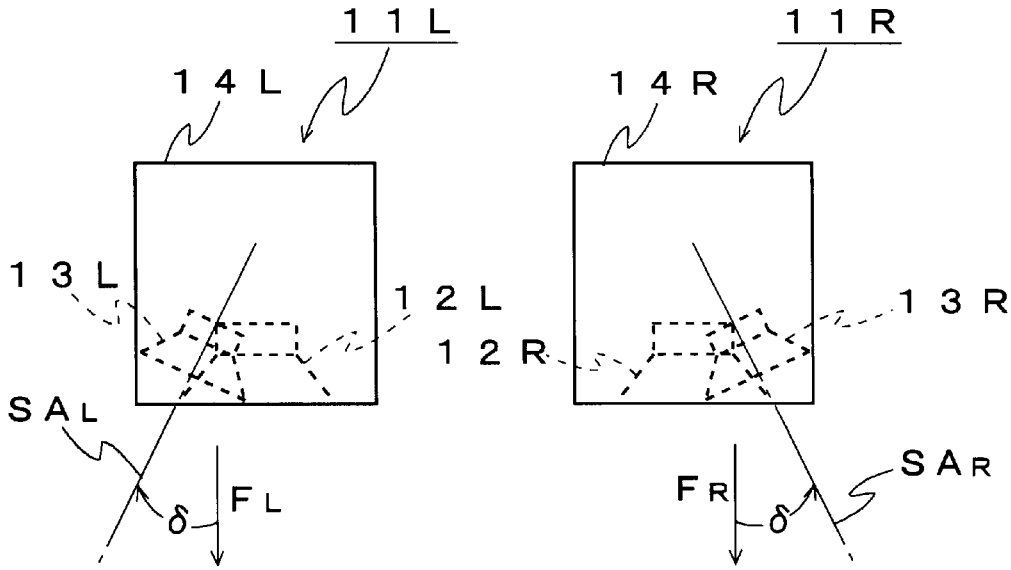
FIG. 33 is a view showing an example in which the principal axes of the surround signal reproducing speakers are directed outwardly.

Therefore, by directing the principal axes $SA_L$ and $SA_R$ of the speakers 77L and 77R inwardly as mentioned above, at a listening position, for example, at point f (refer to FIG. 31) deviated from the center line M, a level of the surround signal sound of a right channel is reduced and a level of the surround signal sound of a left channel is more or less increased to perform the correcting of a difference in levels based on a difference in attenuation of sounds in distances of the surround signal sound of the two left and right channels. Accordingly, according to the stereophonic speaker device 70 shown by FIG. 16, a listening range providing excellent surround effect can be enlarged.

The applicant has confirmed that the listening range providing excellent stereophonic feeling is enlarged in the stereophonic speaker device 60 shown by FIG. 16 as mentioned above, by an auditory sensation test in which, similar to the stereophonic speaker device 50 shown by FIG. 12, the speaker device 60 shown by FIG. 14 is used as the left channel speaker device and as the right channel speaker device (refer to FIG. 15).

Figure 18:
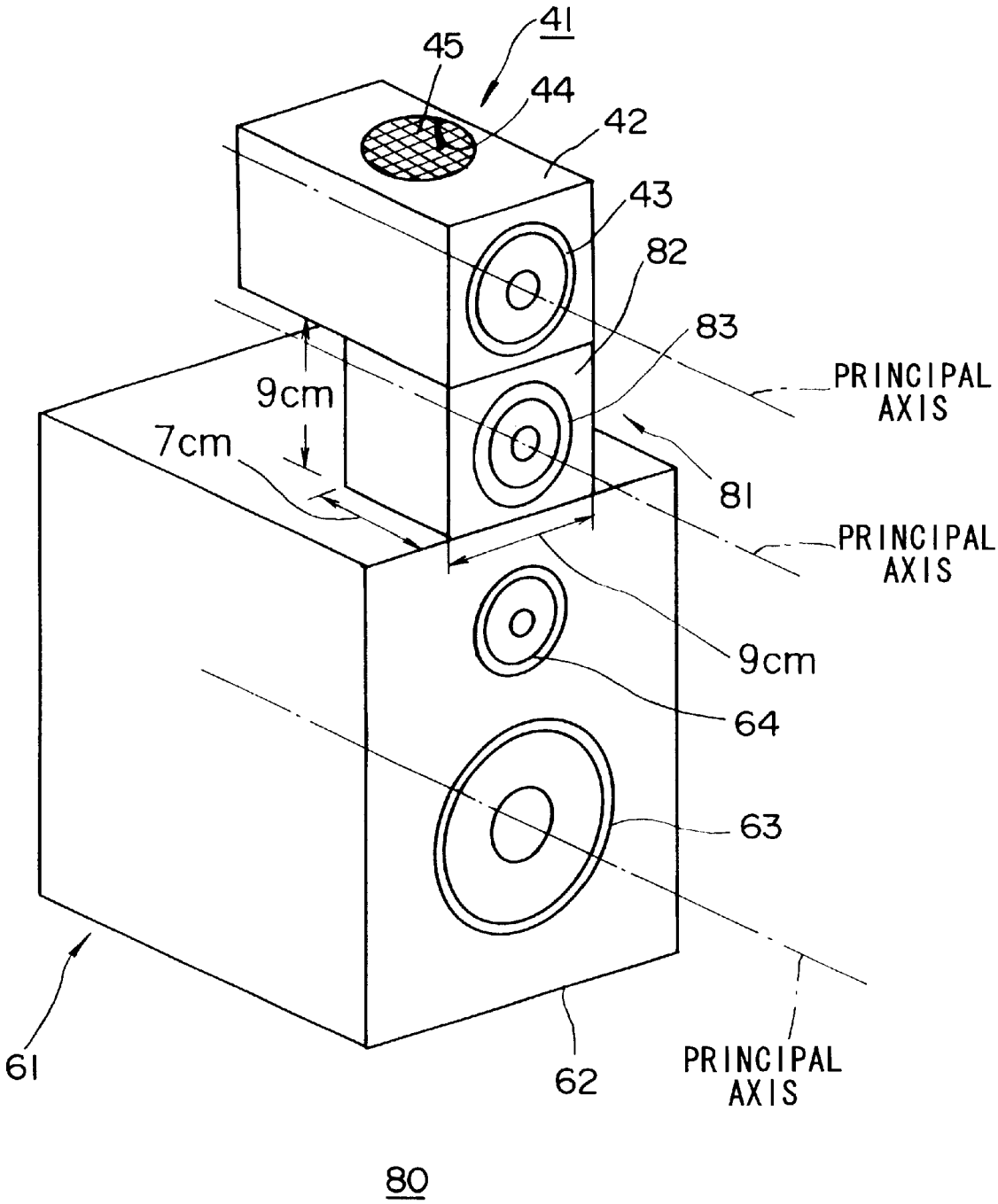
FIG. 18 is a perspective view showing a speaker device used in an auditory sensation test (surround effect) of the speaker device shown by FIG. 16.

Further, the applicant has carried out the auditory sensation test in order to confirm to what degree the listening range providing a surround effect can be enlarged in the case in which the surround signal is reproduced by the surround signal reproducing speakers 77L and 77R of FIG. 16 in addition to the sound signal (LR signals) reproducing devices (speaker device) enlarging the listening range in such a way. FIG. 18 shows a speaker device 80 used as the left channel speaker device and as the right channel speaker device in the auditory sensation test. The speaker device 80 is arranged with a speaker device 81 between the speaker devices 61 and 41 shown by FIG. 14. The speaker device 81 is attached with a surround signal reproducing speaker 83 having an aperture of 8 cm in a closed speaker box 82 of lateral width=9 cm, depth=7 cm and height=9 cm, and a reproduction band thereof falls within a range of 300 Hz through 20 KHz.

Figure 19:
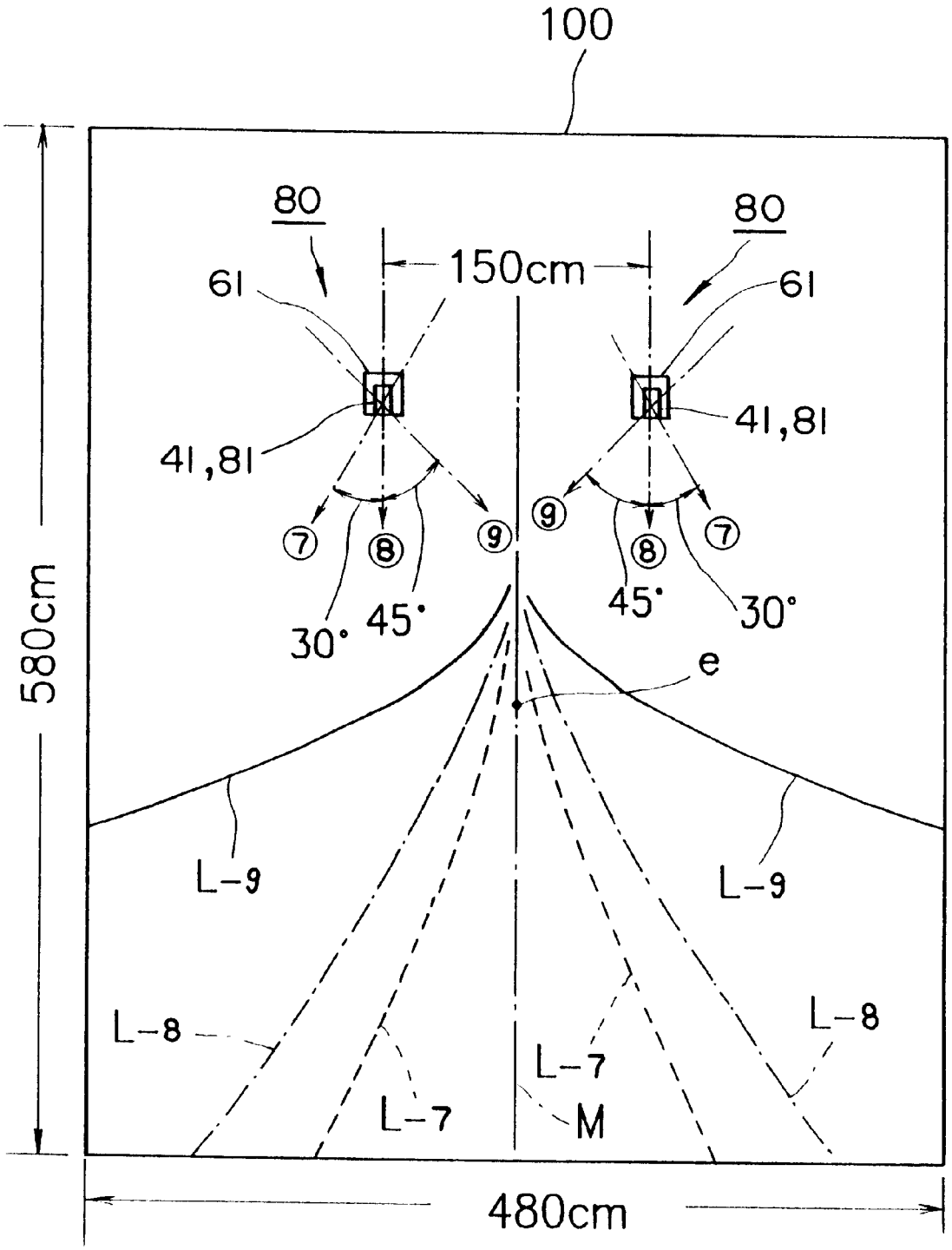
FIG. 19 is a diagram for explaining a result or the like of the auditory sensation test (surround effect) of the speaker device shown by FIG. 16.

The auditory sensation test has been carried out by using the speaker device 80 shown by FIG. 18 as the left channel speaker device and as the right channel speaker device and arranging them in the test listening room 100 having reverberation time of about 0.2 second in a state shown by FIG. 19. The test conditions are as follows: Notation ⑦ of FIG. 19 shows a case in which the speaker devices 41 are not used as the conventional system, but the principal axes of the speakers 83 of the surround signal reproducing speakers devices 81 are directed outwardly by 30° with the principal axes of the woofers 63 and tweeters 64 of the speaker devices 61 of two left and right channels being directed in the front direction (in parallel with side walls of the test listening room 100); Notation ⑧ of FIG. 19 show a case in which the speaker devices 41 are not used as the conventional system, but the principal axes of the speakers 83 of the surround signal reproducing speakers devices 81 are directed in the front direction with the principal axes of the woofers 63 and the tweeters 64 of the speaker devices 61 of two left and right channels being directed in the front direction; Notation ⑨ of FIG. 19 shows a case in which the speaker devices 41 are used as the system according to the present invention, and the principal axes of the speakers 83 of the surround signal reproducing speaker devices 81 are directed inwardly by 45° in the state that the principal axes of the woofers 63 and the tweeters 64 of the speaker devices 61 of two left and right channels are directed in the front direction and the principal axes of the speakers 43 of the speaker devices 41 are directed inwardly by 45°.

Further, in the state in which the principal axes of the speakers 43 of the speaker device 41 are directed in the front direction, a sound pressure level at a listening position, for example, at point e, on the center line M of the two speaker devices 80, 80 of the speaker devices 41 is set to be lower than a sound pressure level of the speaker devices 61 of the 2-way system by 3 dB.

In FIG. 19, broken lines $L_{-7}$ show boundaries of a listening range providing excellent surround effect in the case of the above-described test condition ⑦, and thus an excellent surround effect is achieved within a range on the side of the center line M from the broken line $L_{-7}$. Further, dot-dash lines $L_{-7}$ show boundaries of a listening range providing excellent surround effect in the case of the above-described test condition ⑧, and thus an excellent surround effect is achieved within a range on the side of the center line M from the dot-dash lines $L_{-8}$. Although the listening range providing excellent surround effect is more or less enlarged in this case as compared with the case of ⑦, the range is limited to a narrow range.

In contrast thereto, bold lines $L_{-9}$ show boundaries of a listening range providing excellent surround effect in the case of the above-described test condition⑨ according to the present invention, and thus an excellent surround effect is achieved within a range on the side of the center line M from the bold lines $L_{-9}$. In this case, compared with the case of ⑧, the listening range achieving excellent surround effect is significantly enlarged. Thereby, it has been confirmed that the listening range providing excellent surround effect can further be enlarged by the stereophonic speaker device 70 shown by FIG. 16.

Further, although, according to the stereophonic speaker device 70 shown by FIG. 16, the sound signal reproducing speakers 76L (76R) and the surround signal reproducing speakers 77L (77R) are respectively attached to the speaker attaching faces 75L (75R), they can also be combined by single ones of speakers. In that case, a single one of a speaker is driven by a signal produced by adding surround signal to sound signal.

Figure 20:
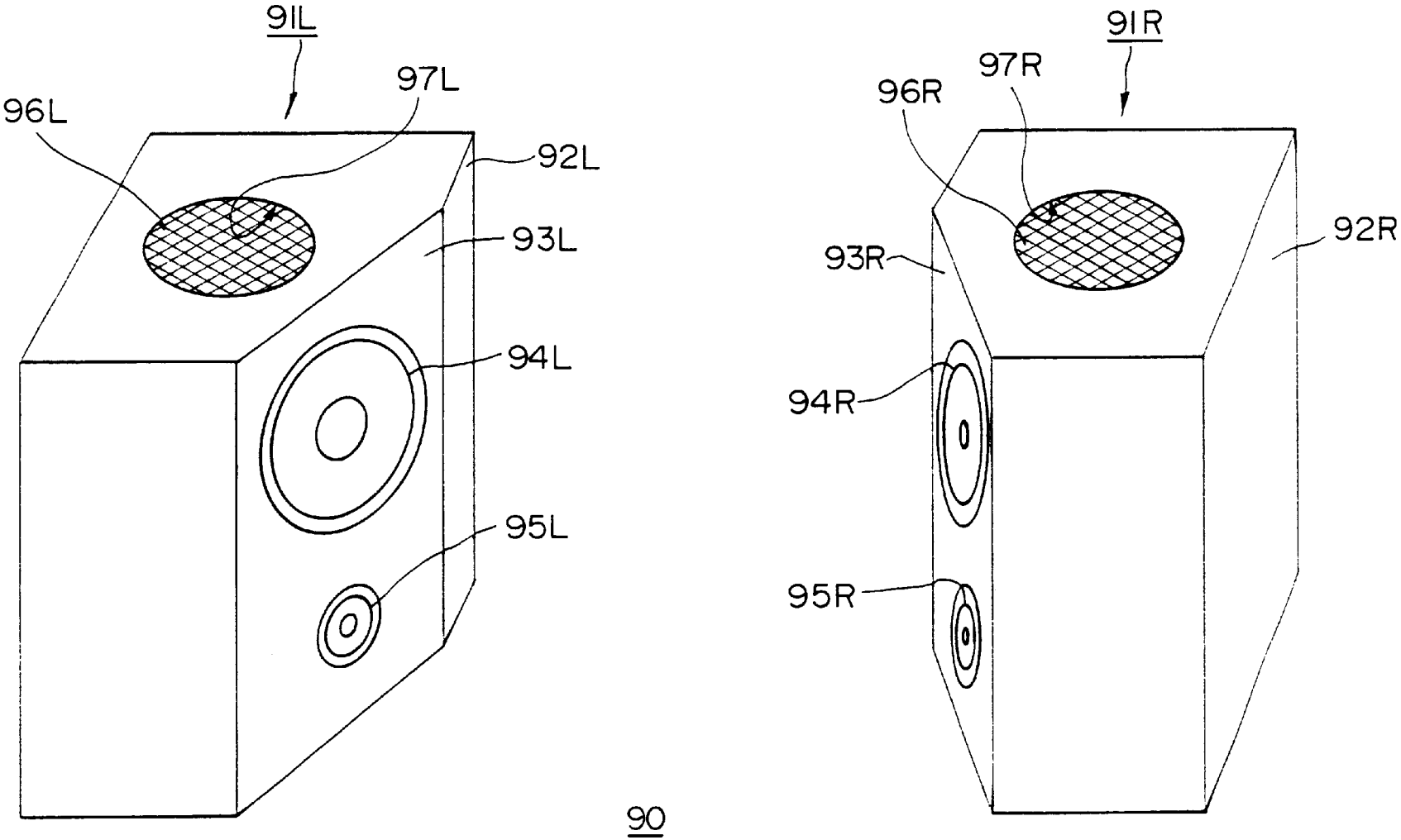
FIG. 20 is a perspective view showing a stereophonic speaker device according to the present invention.

Next, FIG. 20 shows a stereophonic speaker device 90 as still further best mode. The speaker device 90 is constituted by a left channel speaker device 91L and a right channel speaker device 91R.

Figure 21:
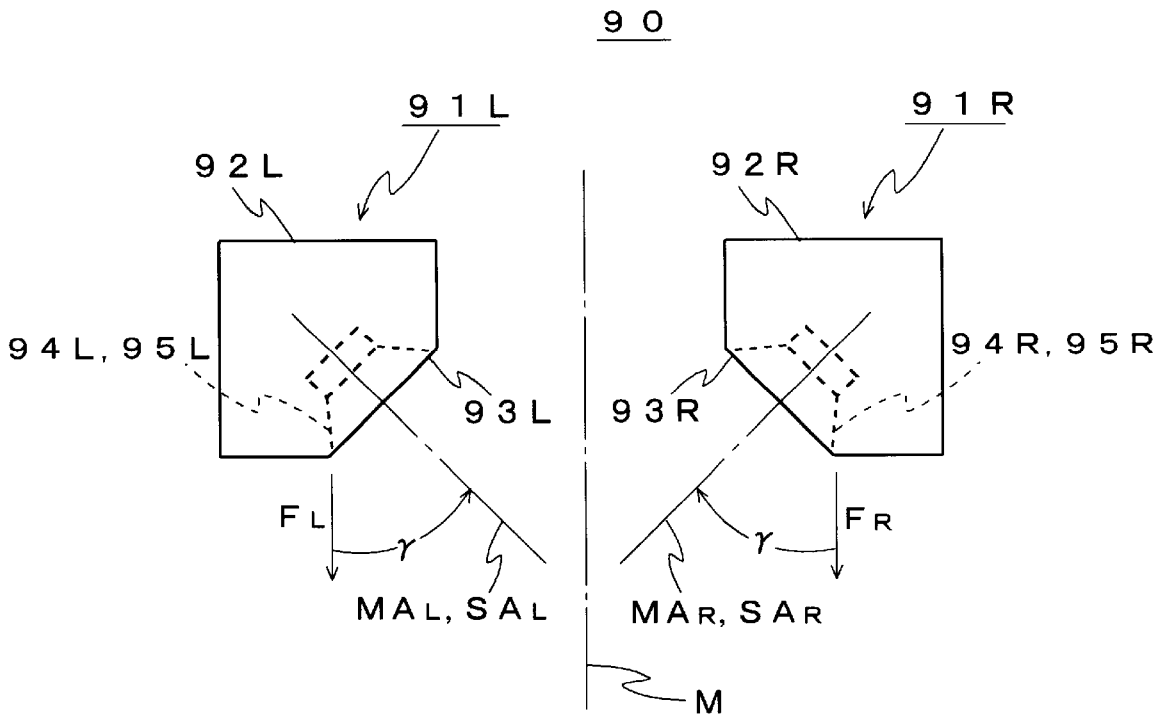
FIG. 21 is a view showing directions of principal axes of speakers for reproducing sound signals and a surround signal of the speaker device shown by FIG. 20.

A speaker attaching face 93L is formed between a front face and a right side face of a speaker box 92L constituting the speaker device 91L and the speaker attaching face 93L is attached with a sound signal reproducing speaker 94L and a surround signal reproducing speaker 95L. In this case, as shown by FIG. 21, the speakers 94L and 95L are attached to the speaker box 92L such that principal axes $MA_L$ and $SA_L$ are inclined by a predetermined angle γ, for example, by 40° through 50°, in the counterclockwise direction relative to a front direction $F_L$ of the speaker box 92L.

Further, a sound wave radiation port (opening portion) 97L in a circular shape covered with an acoustic resistance material 96L is installed at an end face (upper face in the drawing) thereof different from the speaker attaching face 93L of the speaker box 92L. The sound wave radiation port 97L intends to radiating air vibration produced by a rear face of a diaphragm of the speaker 94L to the outside as sound wave and is formed such that an axis penetrating the center thereof is extended in a direction of the principal axis of the speaker 94L. Although not mentioned above, at inside of the speaker box 92L, a box portion attached with the speaker 94L is partitioned from other box portion.

In this case, an acoustic low pass filter is constituted by acoustic capacitance provided by air in the box portion attached with the speaker 94L of the speaker box 92L and acoustic resistance and acoustic mass of the sound wave radiation port 97L. Further, group delay time in a pass band of sound wave radiated from the sound wave radiation port 97L via the low pass filter is utilized and the speaker portion constituted by the speaker 94L of the speaker device 91L is provided with a directivity provided by a combination of omnidirectionality and bidirectionality such that synthesized sound pressure of sound waves radiated from two sound sources of the front face of the speaker 94L and the sound face radiation port 97L is provided with a maximum sensitivity on the front principal axis of the speaker 94L.

A speaker box 92R constituting the speaker device 91R is formed with a speaker attaching face 93R between a front face and a left side face thereof and the speaker attaching face 93R is attached with a sound signal reproducing speaker 94R and a surround signal reproducing speaker 95R. In this case, as shown by FIG. 21, the speakers 94R and 95R are attached to the speaker box 92R such that principal axes $MA_L$ and $SA_L$ thereof are inclined by the predetermined angle γ, for example, by 40° through 50° in the clockwise direction relative to the front direction FL of the speaker box 92R.

Further, a sound wave radiation port (opening portion) 97R in a circular shape covered with acoustic resistance material 96R is installed at an end face (upper face in the drawing) different from the speaker attaching face 93R of the speaker box 92R. The sound wave radiation port 97R intends to radiate air vibration produced by a rear face of a diaphragm of the speaker 94R to the outside as sound wave and is formed such that an axis penetrating the center thereof is extended in a direction of the principal axis of the speaker 94R. Although not mentioned above, at inside of the speaker box 92R, a box portion attached with the speaker 94R is partitioned from other box portion.

In this case, a low pass filter is constituted by acoustic capacitance produced by air in the box portion attached with the speaker 94R of the speaker box 92R and acoustic resistance and acoustic mass of the sound wave radiation port 97R. Further, group delay time in a pass band of sound wave radiated from the sound wave radiation port 97R via the low pass filter is utilized and the speaker portion constituted by the speaker 94R of the speaker device 91R is provided with a directivity provided by a combination of omnidirectionality and bidirectionality such that synthesized sound pressure of sound waves radiated from two sound sources of the front face of the speaker 94R and the sound wave radiation port 97R is provided with a maximum sensitivity on the front principal axis of the speaker 94R.

According to the stereophonic speaker device 90 shown by FIG. 20, the principal axes $MA_L$ and $MA_R$ of the sound signal reproducing speakers 94L and 94R are inclined by the predetermined angle γ respectively in the counterclockwise direction and the clockwise direction relative to the front directions $F_L$ and $F_R$ of the speaker boxes 92L and 92R and then the principal axes $MA_L$ and $MA_R$ of the speakers 94L and 94R are directed inwardly in view from a listening position on the center line M of the speaker devices 91L and 91R (refer to FIG. 21). Further, the speaker portions constituted by the speakers 94L and 94R of the speaker devices 91L and 91R are provided with the directivities each provided by the combination of bidirectionality and omnidirectionality having a maximum sensitivity on the front principal axes.

Accordingly, at a listening position, for example, at point b (refer to FIG. 28) deviated from the center line M of the speaker device 91L and 91R, a sound pressure level of a right channel is reduced, but a sound pressure level of a left channel is more or less increased and then a difference in the sound pressure levels based on a difference in attenuation of sound in distances to the two left and right channels is corrected. Therefore, according to the stereophonic speaker device 90 shown by FIG. 20, the listening range providing excellent stereophonic feeling can be enlarged similar to the stereophonic speaker device 70 shown by FIG. 16.

Further, according to the stereophonic speaker device 90 shown by FIG. 20, the principal axes $SA_L$ and $SA_R$ of the surround signal reproducing speakers 95L and 95R are inclined by the predetermined angle γ respectively in the counterclockwise direction and the clockwise direction relative to the front directions $F_L$ and $F_R$ of the speaker boxes 92L and 92R. Therefore, the principal axes $SA_L$ and $SA_R$ of the speakers 95L and 95R are directed inwardly in view from a listening position on the center line M of the speaker devices 91L and 91R (refer to FIG. 21). Therefore, similar to the stereophonic speaker device 70 shown by FIG. 16, at a listening position deviated from the center line M of the speaker device 91L and 91R, a difference in levels based on a difference in attenuation of sound in distances of the surround signal sound of left and right channels from the speakers 95L and 95R is corrected and accordingly, the listening range providing excellent surround effect can be enlarged.

Further, although, according to the stereophonic speaker device 90 shown by FIG. 20, the surround signal reproducing speakers 94L (94R) and the surround signal reproducing speakers 95L (95R) are respectively attached to the speaker attaching faces 93L (93R), they can also be combined by single ones of speakers. In this case, a single one of a speaker is driven by a signal produced by adding a surround signal to a sound signal.

In this way, according to the stereophonic speaker devices 70 and 90 shown by FIG. 16 and FIG. 20, the principal axes of the sound signal reproducing speakers of the speaker devices for the left channel and the right channel are directed inwardly in view from a listening position on the center line of the two speaker devices and the speaker portions constituted by the sound signal reproducing speakers of the two speaker devices are provided with the directivities each provided by the combination of bidirectionality and omnidirectionality. Accordingly, at a listening position deviated from the center line of the two speaker devices, a difference in sound pressure levels based on a difference in attenuation of sound in distances to the two left and right channels is corrected and the listening range providing excellent stereophonic feeling can be enlarged.

Further, the speaker portions constituted by the sound signal reproducing speakers of the two speaker devices are provided with the directivities each provided by the combination of bidirectionality and omnidirectionality and the directivity can be provided by utilizing group delay time of sound wave radiated from, for example, the sound wave radiation port, so that there is provided a merit capable of downsizing the system constitution as compared with a case in which the directivity provided by a speaker per se is utilized as in the conventional case or a bidirectional speaker is utilized.

Further, the principal axes of the speakers for reproducing the surround signal of the speaker devices for the left channel and the right channel are directed inwardly in view from a listening position on the center line of the two speaker devices and accordingly, at a listening position deviated from the center line of two speaker devices, a difference in levels based on a difference in attenuation of sound in distances of surround signal sound from the two left and right channels is corrected by the directivities of the speakers for reproducing the surround signal at middle and high frequencies, an effect of enlarging the listening range in respect of sound signal (LR signal) reproducing sound, mentioned above, is added and accordingly, the listening range providing excellent surround effect can significantly be enlarged.

Further, the low pass filter is constituted by the acoustic resistance and the acoustic mass of the sound wave radiation port and the acoustic capacitance provided by air in the speaker box and the directivity is provided by utilizing group delay time in the pass band of sound wave radiated from the sound wave radiation port via the low pass filter, whereby an arbitrary group delay time period is set regardless of dimensions or shape of the speaker box and desired directivity can stably be provided down to ultra low frequencies.

Figure 22:
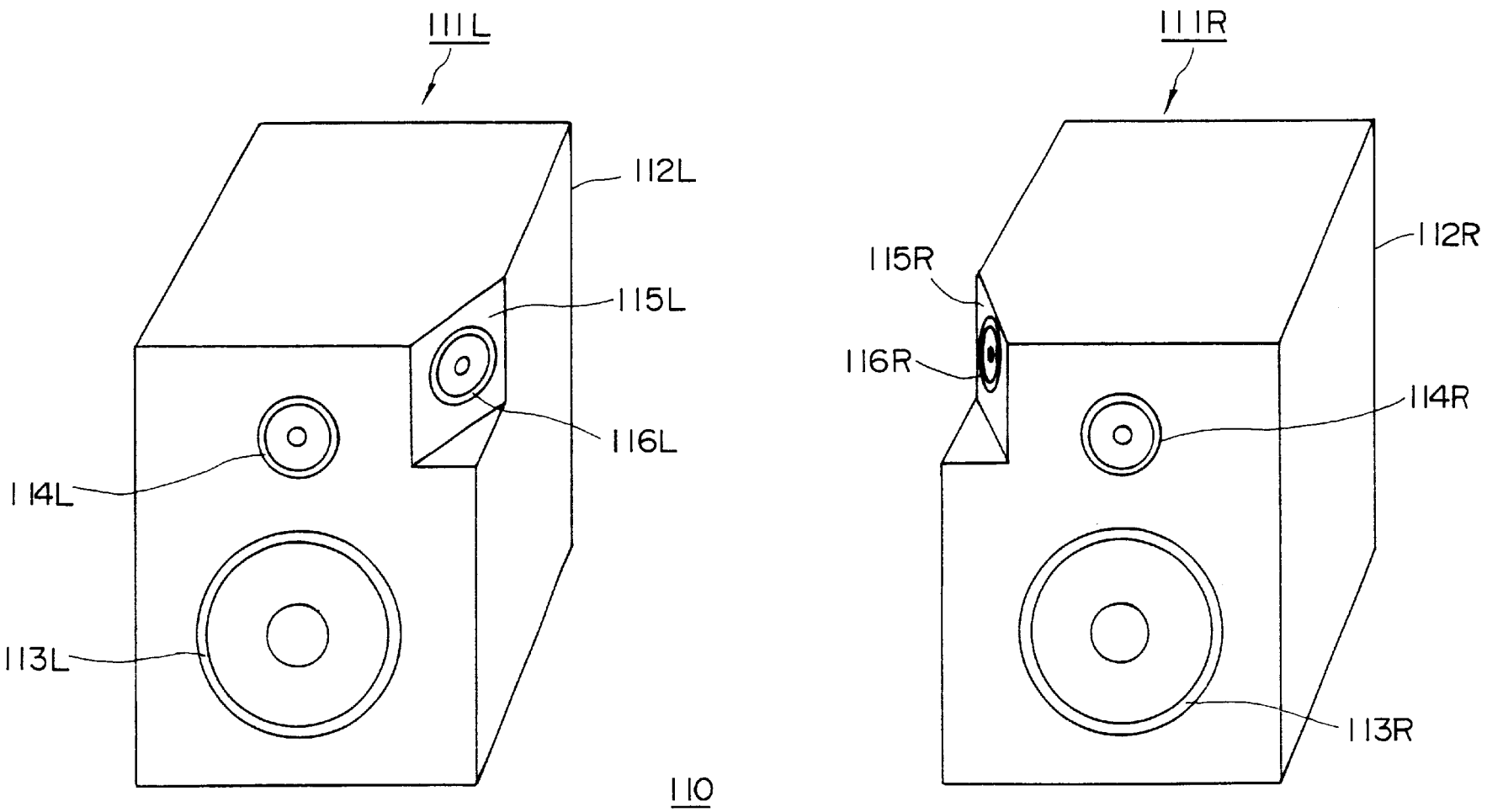
FIG. 22 is a perspective view showing a front surround speaker device according to the present invention.

Next, FIG. 22 shows a front surround speaker device as still another best mode. The speaker device 110 is constituted by a left channel speaker device 111L and a right channel speaker device 111R.

Figure 23:
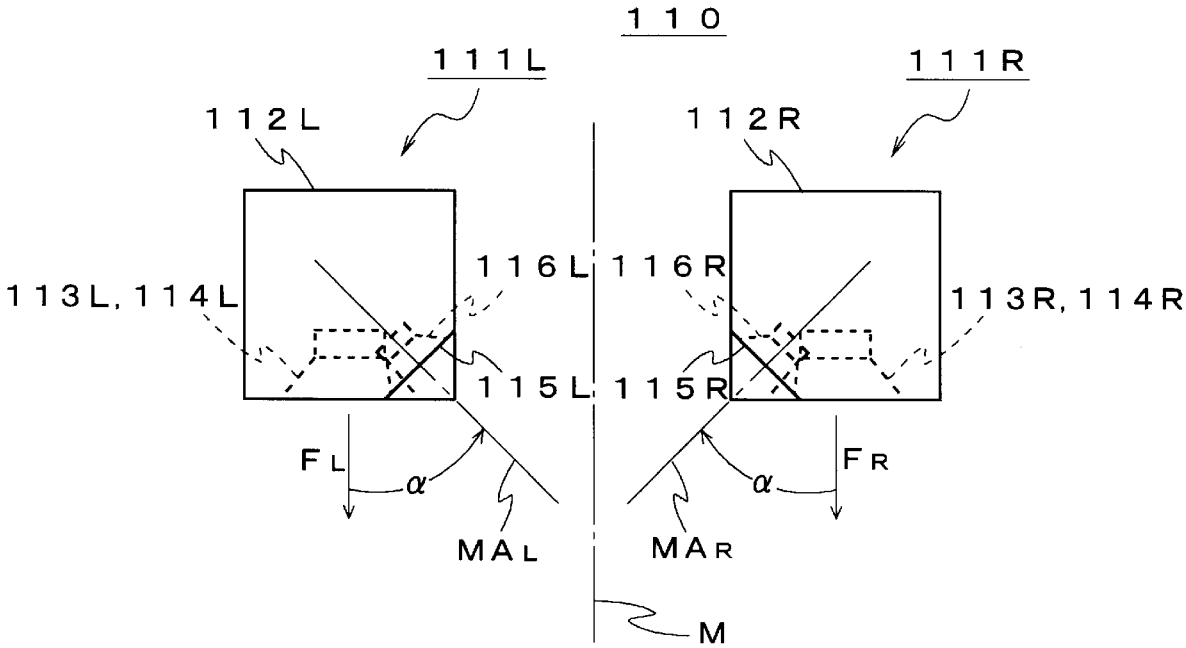
FIG. 23 is a view showing directions of principal axes of speakers for reproducing a surround signal of the speaker device shown by FIG. 22.

The speaker device 111L is of a 2-way system in which a woofer 113L and a tweeter 114L constituting sound signal reproducing speakers are attached to a front face of a speaker box 112L substantially in a shape of a rectangular parallelepiped. The woofer 113L and the tweeter 114L are attached to the front face side of a speaker box 112L such that principal axes thereof are directed in the front direction of the speaker box 112L. Further, the speaker box 112L is formed with a speaker attaching face 115L by cutting off an upper portion of a corner constituted by a front face and a right side face thereof and the attaching face 115L is attached with a surround signal reproducing speaker 116L. In this case, as shown by FIG. 23, the speaker 116L is attached to the speaker box 112L such that a principal axis $MA_L$ is inclined by a predetermined angle α, for example, by 40° through 50°, in the counterclockwise direction relative to a front direction $F_L$ of the speaker box 112L.

The speaker device 110R is of a 2-way system in which a woofer 113R and a tweeter 114R constituting sound signal reproducing speakers are attached to the front face of a speaker box 112R substantially in a shape of a rectangular parallelepiped. The woofer 113R and the tweeter 114R are attached to the front face side of the speaker box 112R such that a principal axis thereof is directed in the front direction of the speaker box 112R. Further, the speaker box 112R is formed with a speaker attaching face 115R by cutting off an upper portion of a corner constituted by a front face and a left side face thereof and the attaching face 115R is attached with a surround signal reproducing speaker 116R. In this case, as shown by FIG. 23, the speaker 116R is attached to the speaker box 112R such that a principal axis $MA_R$ thereof is inclined by the predetermined angle α, for example, by 40° through 50°, in the clockwise direction relative to a front face direction $F_R$ of the speaker box 112R.

According to the front surround speaker device 110 shown by FIG. 22, the principal axes $MA_L$ and $MA_R$ of the speakers 116L and 116R are inclined by the predetermined angle α respectively in the counterclockwise direction and the clockwise direction relative to the front directions $F_L$ and $F_R$ of the speaker boxes 112L and 112R. Therefore, the principal axes $MA_L$ and $MA_R$ of the speakers 116L and 116R are directed inwardly in view from a listening position on the center line M of the speaker devices 111L and 111R (refer to FIG. 23).

Generally, an S signal component, which is a major component of a surround signal, is a signal having major components in middle and high frequencies. Further, according to the speakers 116L and 116R, diaphragms thereof are provided with limited areas and accordingly, as shown by FIG. 34, radiated sound wave per se is provided with a directivity in middle and high frequencies.

Accordingly, as mentioned above, by directing inwardly the principal axes $MA_L$ and $MA_R$ of the speakers 116L and 116R, a level of surround signal sound of a right channel is reduced and a level of surround signal sound of a left channel is more or less increased at a listening position deviated from the center line M, for example, at point f (refer to FIG. 31), and thus a difference in levels based on a difference in attenuation of sound in distances of surround signal sound of the two left and right channels is corrected. Therefore, according to the front surround speaker device 110 shown by FIG. 22, a listening range providing excellent surround effect can be enlarged.

Figure 24:
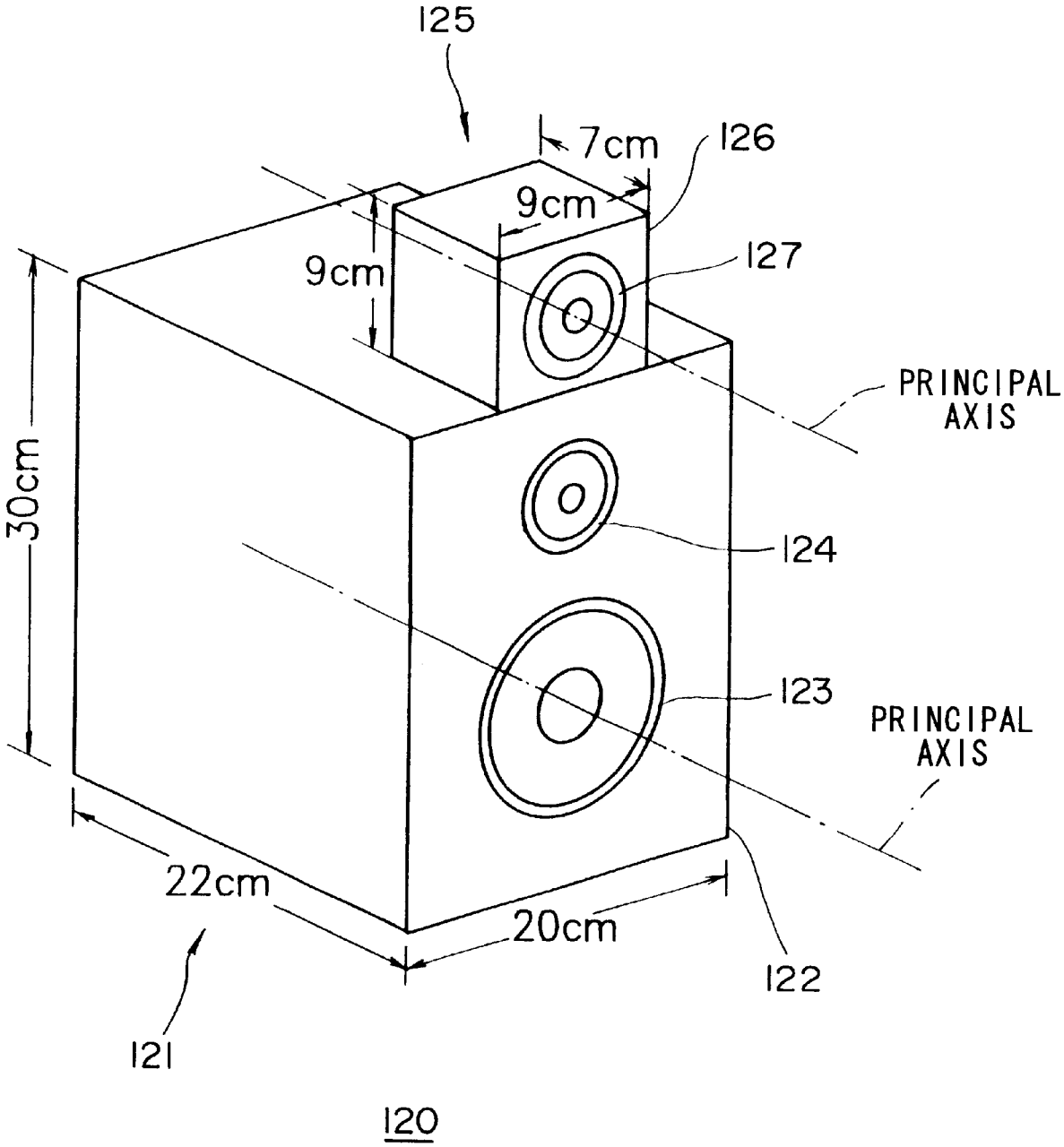
FIG. 24 is a perspective view showing a speaker device used in an auditory sensation test of the speaker device shown by FIG. 22.

The applicant has carried out an auditory sensation test in order to confirm that the listening range providing excellent surround effect is enlarged in the front surround speaker device 110 shown by FIG. 22 as mentioned above. FIG. 24 shows a speaker device 120 used as a left channel speaker device and as a right channel speaker device in the auditory sensation test. The speaker device 120 is constituted by arranging a speaker device 125 on a speaker device 121. The speaker device 121 is of a 2-way system in which a woofer 123 having an aperture of 14 cm and a tweeter 124 having an aperture of 8 cm, for reproducing sound signals attached to a speaker box 122 of lateral width =20 cm, depth=22 cm and height=30 cm, and a reproduction band thereof falls in a range of 50 Hz through 20 kHz. Further, the speaker device 125 is attached with a surround signal reproducing speaker 127 having an aperture of 8 cm in a closed speaker box 126 of lateral width=9 cm, depth=7 cm and height=9 cm, and a reproduction band thereof falls in a range of 300 Hz through 20 kHz.

Figure 25:
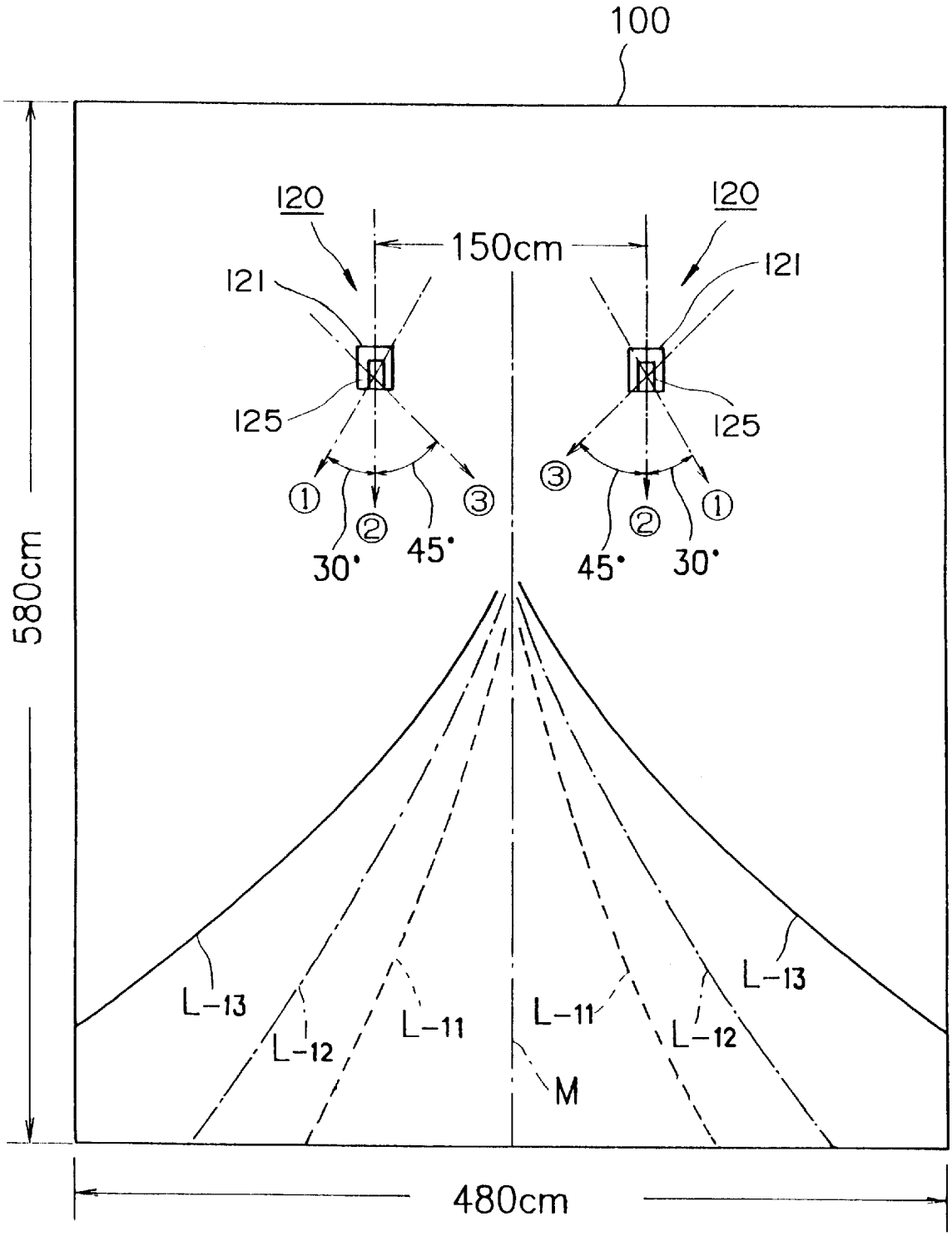
FIG. 25 is a diagram showing a result or the like of the auditory sensation test of the speaker device shown by FIG. 22.

An auditory sensation test has been carried out by using the speaker device 120 shown by FIG. 24 as a left channel speaker device and as a right channel speaker device and arranging them in the test listening room 100 having reverberation time of about 0.2 second in a state shown by FIG. 25. Further, in the auditory sensation test, in a state in which the principal axes (reference axes) of the woofers 123 and the tweeters 124 of the speaker devices 121 constituting the speaker devices 120 for the left channel and for the right channel are directed in the front direction (in parallel with side walls of the test listening chamber 100), listening ranges providing excellent surround effect are determined in cases: ① in which the principal axes of the speakers 127 of the speaker devices 125 are directed outwardly by 30°; ② in which the principal axes of the speakers 127 of the speaker devices 125 are directed in the front direction; and ③ in which the principal axes of the speakers 127 of the speaker devices 125 are directed inwardly by 45°.

In FIG. 25, broken lines $L_{-11}$ show boundaries of a listening range providing excellent surround effect in the case in which the principal axes of the surround signal reproducing speakers 127 are directed outwardly by 30°, and then an excellent surround effect is achieved within a range on the side of the center line M from the broken lines $L_{-11}$. Further, dot-dash lines $L_{-12}$ show boundaries of a listening range providing excellent surround effect in the case in which the principal axes of the speakers 127 are directed in the front direction, and then an excellent surround effect is achieved within a range on the side of the center line M from the dot-dash lines $L_{-12}$. In this case, the listening range achieving the excellent surround effect is more or less enlarged, compared with the case in which the principal axes of the speakers 127 are directed outwardly by 30°.

In contrast thereto, bold lines $L_{-13}$ show boundaries of a listening range providing excellent surround effect in the case in which the principal axes of the speakers 127 are directed inwardly by 45°, and then excellent surround effect is achieved within a range on the side of the center line M from the bold lines $L_{-12}$. In this case, compared with the case in which the principal axes of the speakers 127 are directed in the front direction, the listening range providing excellent surround effect is further enlarged. Thereby, it has been confirmed that the listening range providing excellent surround effect can be enlarged by the front surround speaker device 110 shown by FIG. 22.

Figure 26:
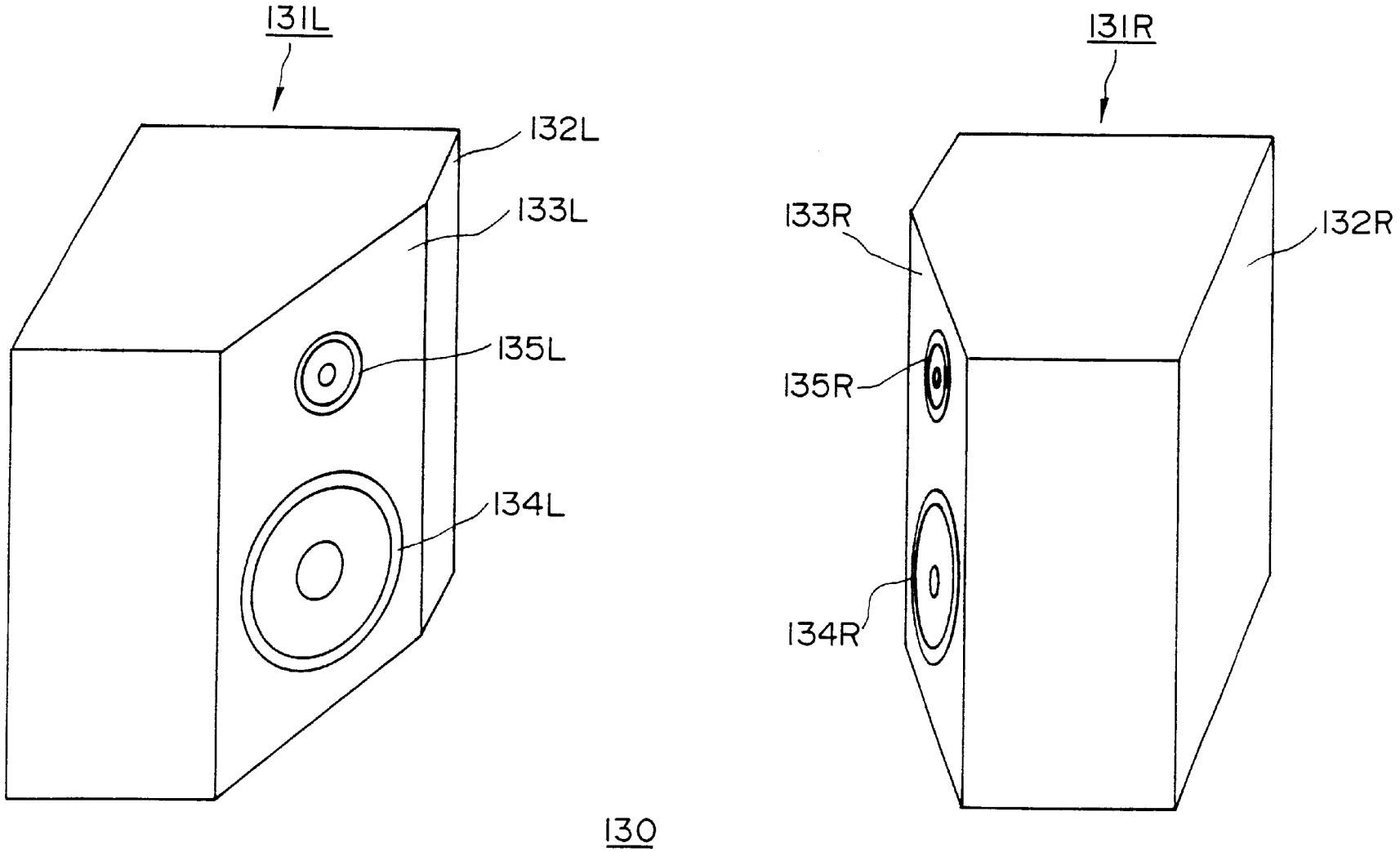
FIG. 26 is a perspective view showing a front surround speaker device according to the present invention.

Next, FIG. 26 shows a front surround speaker device 130 as still further best mode. The speaker device 130 is constituted by a left channel speaker device 131L and a right channel speaker device 131R.

Figure 27:
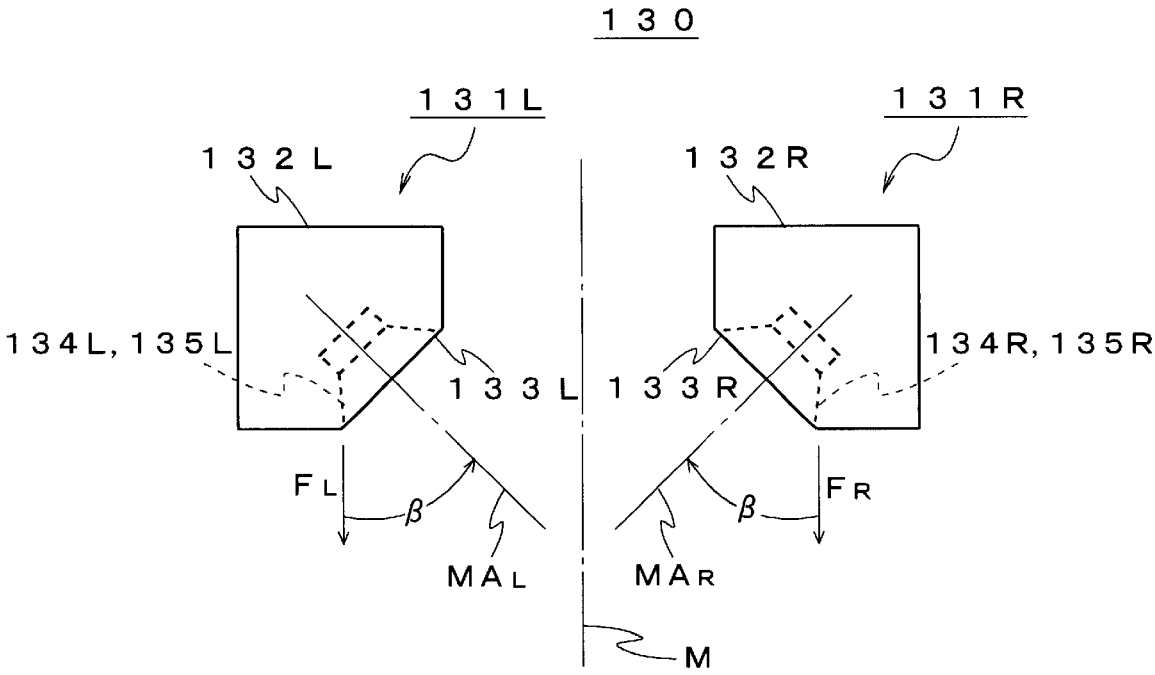
FIG. 27 is a view showing directions of principal axes of speakers for reproducing a surround signal of the speaker device shown by FIG. 26.

A speaker box 132L constituting the speaker device 131L is formed with a speaker attaching face 133L between a front face and a right side face thereof. Further, the speaker device 131L is of a 2-way system in which a woofer 134L and a tweeter 135L are attached to the speaker attaching face 133L. The woofer 134L and the tweeter 135L function as sound signal reproducing speakers and function also as sound signal reproducing speakers. In this case, as shown by FIG. 27, the woofer 134L and the tweeter 135L are attached to the speaker box 132L such that a principal axis $MA_L$ thereof is inclined by a predetermined angle β, for example, by 40° through 50°, in the counterclockwise direction relative to a front direction $F_L$ of the speaker box 132L.

Further, a speaker box 132R constituting the speaker device 131R is formed with a speaker attaching face 133R between a front face and a left side face thereof. Further, the speaker device 131R is of a 2-way system in which a woofer 134R and a tweeter 135R are attached to the speaker attaching face 133R. The woofer 134R and the tweeter 135R function as sound signal reproducing speakers and function also as surround signal reproducing speakers. In this case, as shown by FIG. 27, the woofer 134R and the tweeter 135R are attached to the speaker box 132R such that a principal axis $MA_R$ thereof is inclined by the predetermined angle β, for example, by 40° through 50°, in the clockwise direction relative to a front direction $F_R$ of the speaker box 132R.

According to the front surround speaker device 130 shown by FIG. 26, the principal axes $MA_L$ and $MA_R$ of the speakers (134L, 135L) and (134R, 135R) reproducing surround signals are inclined by the predetermined angle β respectively in the counterclockwise direction and the clockwise direction relative to the front directions $F_L$ and $F_R$ of the speaker boxes 132L and 132R. Accordingly, the principal axes $MA_L$ and $MA_R$ of the speakers (134L, 135L) and (134R, 135R) are directed inwardly in view from a listening position on the center line M of the speaker devices 131L and 131R (refer to FIG. 27). Accordingly, similar to the front surround speaker device 110 shown by FIG. 22, a difference in levels based on a difference in attenuation of sound in distances of surround signal sound of the two left and right channels from the speakers (134L, 135L) and (134R, 135R) is corrected at a listening position deviated from the center line M of the speaker devices 131L and 131R, and then a listening range providing excellent surround effect can be enlarged.

Further, although the speaker devices 110 and 130 show examples of speaker devices of the 2-way system, the present invention is not naturally limited to the system. The gist of embodiments resides in that the speakers for reproducing the surround signal of the speaker devices for the left channel and for the right channel are attached to the speaker boxes such that the principal axes thereof are inclined by the predetermined angle respectively in the counterclockwise direction and the clockwise direction relative to the front directions of the speaker boxes.

In this way, according to the front surround speaker devices 110 and 130 shown by FIG. 22 and FIG. 26, the principal axes of the speakers for reproducing the surround signal of the speaker devices for the left channel and for the right channel are directed inwardly in view from a listening position on the center line of the two speaker devices and accordingly, at a listening position deviated from the center line of the two speaker devices, a difference in levels based on a difference in attenuation of sound in distances of surround signal sound of the two left and right channels is corrected by the directivities of the speakers for reproducing the surround signals at middle and high frequencies and accordingly, the listening range providing excellent surround effect can be enlarged.

INDUSTRIAL APPLICABILITY

As has been described, the speaker device according to the present invention is preferably applied in order to enlarge a listening range providing excellent stereophonic feeling or a listening range providing excellent front surround effect in, for example, a television receiver, an audio system or the like.

What is claimed is:

1. A stereophonic speaker system comprising left and right speaker devices spaced apart along a separation axis that is perpendicular to a front direction of the speaker system, the left channel speaker device comprising a left speaker box having first and second faces and also comprising a left speaker for reproducing a left channel sound signal, the left speaker having a principal axis and being attached to the left speaker box at the first face thereof, the right channel speaker device comprising a right speaker box having first and second faces and also comprising a right speaker for reproducing a right channel sound signal, the right speaker having a principal axis and being attached to the right speaker box at the first face thereof, wherein the second face of each speaker box has a sound wave radiation port covered with an acoustic resistance material, whereby an acoustic low pass filter is constituted by an acoustic capacitance provided by air in the speaker box and an acoustic resistance and an acoustic mass of the sound wave radiation port, and wherein the speaker devices are oriented such that the principal axis of the left speaker is inclined in a counterclockwise direction relative to the front direction of the speaker system and the principal axis of the right speaker is inclined in a clockwise direction relative to the front direction of the speaker system.

2. A speaker system according to claim 1, wherein the principal axis of the left speaker is inclined at an angle from 40° to 50° relative to the front direction of the speaker system and the principal axis of the right speaker is inclined at an angle from 40° to 50° relative to the front direction of the speaker system.

3. A speaker system according to claim 1, wherein the principal axes of the left and right speakers are inclined to the front direction of the speaker system at angles of equal respective magnitudes.

4. A stereophonic speaker system comprising left and right speaker devices spaced apart along a separation axis that is perpendicular to a front direction of the speaker system, the left channel speaker device comprising a left speaker box having first and second faces and also comprising first and second left speakers for reproducing a left channel sound signal, the first left speaker having a principal axis and being attached to the left speaker box at the first face thereof, the right channel speaker device comprising a right speaker box having first and second faces and also comprising first and second right speakers for reproducing a right channel sound signal, the first right speaker having a principal axis and being attached to the right speaker box at the first face thereof, wherein the second face of each speaker box has a sound wave radiation port covered with an acoustic resistance material, whereby an acoustic low pass filter is constituted by an acoustic capacitance provided by air in the speaker box and an acoustic resistance and an acoustic mass of the sound wave radiation port, wherein the speaker devices are oriented such that the principal axis of the first left speaker is inclined in a counterclockwise direction relative to the front direction of the speaker system and the principal axis of the first right speaker is inclined in a clockwise direction relative to the front direction of the speaker system, and wherein the second left speaker and the second right speaker are attached to the respective speaker boxes such that respective axes thereof coincide with the front direction of the speaker system.

5. A speaker system according to claim 4, wherein the principal axis of the first left speaker is inclined at an angle from 40° to 50° relative to the front direction of the speaker system and the principal axis of the first right speaker is inclined at an angle from 40° to 50° relative to the front direction of the speaker system.

6. A speaker system according to claim 4, wherein the principal axes of the left and right speakers are inclined to the front direction of the speaker system at angles of equal respective magnitudes.

7. A stereophonic speaker system comprising left and right speaker devices spaced apart along a separation axis that is perpendicular to a front direction of the speaker system, the left channel speaker device comprising a left speaker box having first and second faces and also comprising a first left speaker for reproducing a left channel sound signal and a second left speaker for reproducing a surround signal, the first left speaker having a principal axis and being attached to the left speaker box at the first face thereof, and the second left speaker having a principal axis, the right channel speaker device comprising a right speaker box having first and second faces and also comprising a first right speaker for reproducing a right channel sound signal and a second right speaker for reproducing the surround signal, the first right speaker having a principal axis and being attached to the right speaker box at the first face thereof, and the second right speaker having a principal axis, wherein the second face of each speaker box has a sound wave radiation port covered with an acoustic resistance material, whereby an acoustic low pass filter is constituted by an acoustic capacitance provided by air in the speaker box and an acoustic resistance and an acoustic mass of the sound wave radiation port, wherein the speaker devices are oriented such that the principal axis of the first left speaker is inclined in a counterclockwise direction relative to the front direction of the speaker system and the principal axis of the first right speaker is inclined in a clockwise direction relative to the front direction of the speaker system, wherein the second left speaker is attached to the left speaker box such that the principal axis of the second left speaker is inclined in a counterclockwise direction relative to the front direction of the speaker system, and wherein the second right speaker is attached to the right speaker box such that the principal axis of the second right speaker is inclined in a clockwise direction relative to the front direction of the speaker system.

8. A speaker system according to claim 7, the principal axis of the first left speaker is inclined at an angle from 40° to 50° relative to the front direction of the speaker system and the principal axis of the first right speaker is inclined at an angle from 40° to 50° relative to the front direction of the speaker system.

9. A speaker system according to claim 7, wherein the principal axes of the first left speaker and first right speaker are inclined to the front direction of the speaker system at angles of equal respective magnitudes, and the principal axes of the second left speaker and second right speaker are inclined to the front direction of the speaker system at angles of equal respective magnitudes.

10. A speaker system according to claim 9, wherein the principal axis of the first and second left speakers are inclined to the front direction of the speaker system at angles of equal respective magnitudes.

11. A stereophonic speaker system comprising left and right speaker devices spaced apart along a separation axis that is perpendicular to a front direction of the speaker system, the left channel speaker device comprising a left speaker box having first and second faces and also comprising first and second left speakers for reproducing a left channel sound signal and a third left speaker for reproducing a surround signal, the first left speaker having a principal axis and being attached to the left speaker box at the first face thereof, and the second and third left speakers being attached to the left speaker box and each having a principal axis, the right channel speaker device comprising a right speaker box having first and second faces and also comprising first and second right speakers for reproducing a right channel sound signal and a third right speaker for reproducing the surround signal, the first right speaker having a principal axis and being attached to the right speaker box at the first face thereof, and the second and third right speakers being attached to the right speaker box and each having a principal axis, wherein the second face of each speaker box has a sound wave radiation port covered with an acoustic resistance material, whereby an acoustic low pass filter is constituted by an acoustic capacitance provided by air in the speaker box and an acoustic resistance and an acoustic mass of the sound wave radiation port, wherein the speaker devices are oriented such that the principal axes of the first left and right speakers coincide with the front direction of the speaker system, wherein the second and third left speakers are attached to the left speaker box such that the principal axes of the second and third left speakers are each inclined in a counterclockwise direction relative to the front direction of the speaker system, and wherein the second and third right speakers are attached to the right speaker box such that the principal axes of the second and third right speakers are each inclined in a clockwise direction relative to the front direction of the speaker system.

12. A speaker system according to claim 11, wherein the principal axis of the second left speaker is inclined at an angle from 40° to 50° relative to the front direction of the speaker system and the principal axis of the second right speaker is inclined at an angle from 40° to 50° relative to the front direction of the speaker system.

13. A speaker system according to claim 11, wherein the principal axes of the second left speaker and second right speaker are inclined to the front direction of the speaker system at angles of equal respective magnitudes, and the principal axes of the third left speaker and third right speaker are inclined to the front direction of the speaker system at angles of equal respective magnitudes.

14. A speaker system according to claim 13, wherein the principal axes of the second and third left speakers are inclined to the front direction of the speaker system at angles of equal respective magnitudes.

* * * * *